US007426768B2

(12) United States Patent
Peterson et al.

(10) Patent No.: US 7,426,768 B2
(45) Date of Patent: Sep. 23, 2008

(54) AIR DUCT CLEANING APPARATUS

(75) Inventors: Scott A. Peterson, Fort Worth, TX (US); Tandy P. Watson, Denton, TX (US); Fred M. Gore, Carrolton, TX (US)

(73) Assignee: Rotobrush International LLC, Grapevine, TX (US)

( * ) Notice: Subject to any disclaimer, the term of this patent is extended or adjusted under 35 U.S.C. 154(b) by 748 days.

(21) Appl. No.: 10/860,469

(22) Filed: Jun. 2, 2004

(65) Prior Publication Data

US 2006/0242783 A1 Nov. 2, 2006

(51) Int. Cl.
*A47L 5/38* (2006.01)
*B08B 9/045* (2006.01)

(52) U.S. Cl. ..... 15/304; 15/329; 15/383; 15/314

(58) Field of Classification Search ..... 15/314, 15/327.1, 327.2, 304, 328, 329, 312.1, 312.2, 15/383
See application file for complete search history.

(56) References Cited

U.S. PATENT DOCUMENTS 2,222,513 A * 11/1940 Mulvaney ..... 15/383
2,521,465 A * 9/1950 Leon ..... 15/327.1
3,063,082 A * 11/1962 Rosenberg ..... 15/327.2
3,180,071 A * 4/1965 Nolte ..... 15/328
3,308,609 A * 3/1967 McCulloch et al. ..... 15/327.1
3,837,539 A * 9/1974 Schlegel ..... 15/327.1
4,792,363 A 12/1988 Franklin et al.
5,309,600 A * 5/1994 Weaver et al. ..... 15/328
5,813,089 A * 9/1998 Nolan et al. ..... 15/383
6,014,790 A 1/2000 Smith et al.
6,032,325 A 3/2000 Smith
6,279,197 B1 8/2001 Crutcher et al.

* cited by examiner

*Primary Examiner*—Laura C Guidotti

(57) ABSTRACT

An apparatus for cleaning ducts of a heating/ventilation/air conditioning (HVAC) system is provided. In one embodiment, a pod has a vacuum chamber therein, a drive motor located within the pod and configured to receive a removable drive shaft therein, and a conduit member located within the pod adjacent the drive motor. The conduit member has a vacuum inlet opening at an exterior wall of the pod and a drive shaft exit opening formed in the conduit member through which the removable drive shaft can extend. In one embodiment, the invention comprises a man-portable pod and a cart removably-coupleable to the man-portable pod. A method of manufacturing the apparatus and a method of cleaning an HVAC duct is also provided.

49 Claims, 13 Drawing Sheets

AIR DUCT CLEANING APPARATUS

TECHNICAL FIELD OF THE INVENTION

The present invention is directed, in general, to an air duct cleaning system and, more specifically, to an improved air duct cleaning system for removing dust and debris from air conditioning and heating ducts, dryer vent ducts, etc., of residential and commercial buildings.

BACKGROUND OF THE INVENTION

So called "house dust" is widely considered by experts to pose health hazards to persons with allergies, asthma, or respiratory disorders and diseases. House dust may contain dirt, textile fibers, pollen, hair, skin flakes, residue of chemical and household products, cat and dog dander, decaying organic matter, dust mites, bacteria, fungi, viruses, and a variety of other contaminants. Literally, pounds of house dust accumulate on vents and in ducts that comprise the ventilating systems of both residential and commercial buildings. This house dust is becoming increasingly more harmful as Americans spend a larger percentage of their waking hours indoors, often aggravating allergies of the inhabitants.

Modern heating/ventilating/air conditioning (HVAC) systems typically incorporate air filters either just prior to the circulation fan of the systems or in the return ductwork. However, most often these filters comprise fiberglass or similar media that are reasonably effective against large debris, but are often inadequate in removing fine particulate matter, such as dust, dander, etc., from the circulated air. Such filters may trap as little as twenty percent of the particulate matter circulating in a ventilation system, allowing the remaining dust and debris to circulate in the household or work place. A considerable after-market industry has flourished providing both active and passive electrostatic air filters. However, such filters only address those particles in the air that pass through them after being returned from the living space. The filter does not affect dust and debris that is already present in the ducts downstream of the HVAC unit that may be disturbed by airflow and carried into the living space. Additionally, it is not uncommon to encounter ductwork that has been improperly installed or maintained. These ducts frequently leak, allowing dust and debris from the duct surroundings to enter the ducts. Often this is a major contributor to duct contamination.

Prior to the invention of duct vacuuming systems, one method of addressing this problem was by sealing the dust and debris to the inner walls of the ducts by coating it with a layer of a water-based resin, known in the trade as "duct sealer" or "soot sealer". This compound is commonly used in fire restoration of ventilating systems. After physically cleaning and sealing the outflow registers, a hole is cut in the duct of the ventilating system. An electric misting fogger is then mounted over the hole. The fogger is activated and the soot sealer is dispersed throughout the ventilating system. The soot sealer forms a coating over the inner walls of the entire duct system, encapsulating dust and other harmful impurities. Thus, the dust is not removed from the system, but rather the sealant forms a new interior duct surface with the dust trapped between the duct wall and the sealant surface. This method has several inherent limitations. However, the drawbacks to this system is its cost and the fact that the water based soot sealer, given the right humidity conditions, may dissolve, thereby freeing trapped dust and debris.

A more recent approach to the problem of debris in ventilation ducts has been to use a rotating brush at the end of a flexible vacuum hose that is fed into each duct from each register location. The hose is fed toward the outflow portion of the HVAC system to the limit of the hose length. Practically speaking, the hose is usually about 25 feet to 35 feet long. Additionally, the vacuum-generating units of these systems have been quite large and, while mobile, were of such a size and weight that they are impracticable to take into an attic. Yet, because of excessively long ductwork, it has sometimes been necessary to make multiple entries along the duct system in order to completely clean the ducts. It is sometimes impractical to properly clean the ducts of modern homes with high, two-story ceilings with this system. Most of the available hose would be used just to reach a register that is 15 to 18 feet above the floor. Extending the hose by using additional lengths was difficult because of the need to also extend the brush drive mechanism throughout the additional lengths of the hose. Additionally, these conventional systems, due to their general configurations, may make it difficult to position the duct cleaning machine close to the system being cleaned in order to maximize use of available hose.

Accordingly, what is needed in the art is an apparatus that offers a more flexible and mobile approach for cleaning HVAC ducts.

SUMMARY OF THE INVENTION

To address the above-discussed deficiencies of the prior art, the present invention provides an improved apparatus for cleaning ducts of a heating/ventilation/air conditioning (HVAC) system. In one embodiment, the present invention comprises a pod having a vacuum chamber therein, a drive motor located within the pod and configured to receive a removable drive shaft therein, and a conduit member located within the pod adjacent the drive motor. The conduit member has a vacuum inlet opening at an exterior wall of the pod and a drive shaft exit opening formed in the conduit member through which the removable drive shaft can extend. The conduit member further includes a curve along an air path center line of the conduit member, wherein the curve has an obtuse angle taken from a center line normal to the vacuum inlet opening.

In another aspect, the present invention comprises a man-portable pod having a vacuum chamber and a motor therein, a conduit member located within the man-portable pod and a cart removably-coupleable to the man-portable pod. The conduit member has a vacuum chamber end and a vacuum hose end and an air path therebetween. The vacuum chamber end is in fluid communication with the vacuum chamber and the vacuum hose end is coupleable to an end of a flexible vacuum hose. The cart is configured to provide rollable conveyance for the man-portable pod and attached hose including up and down stairs. A method of manufacturing the apparatus and a method of cleaning an HVAC duct is also provided.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1A:
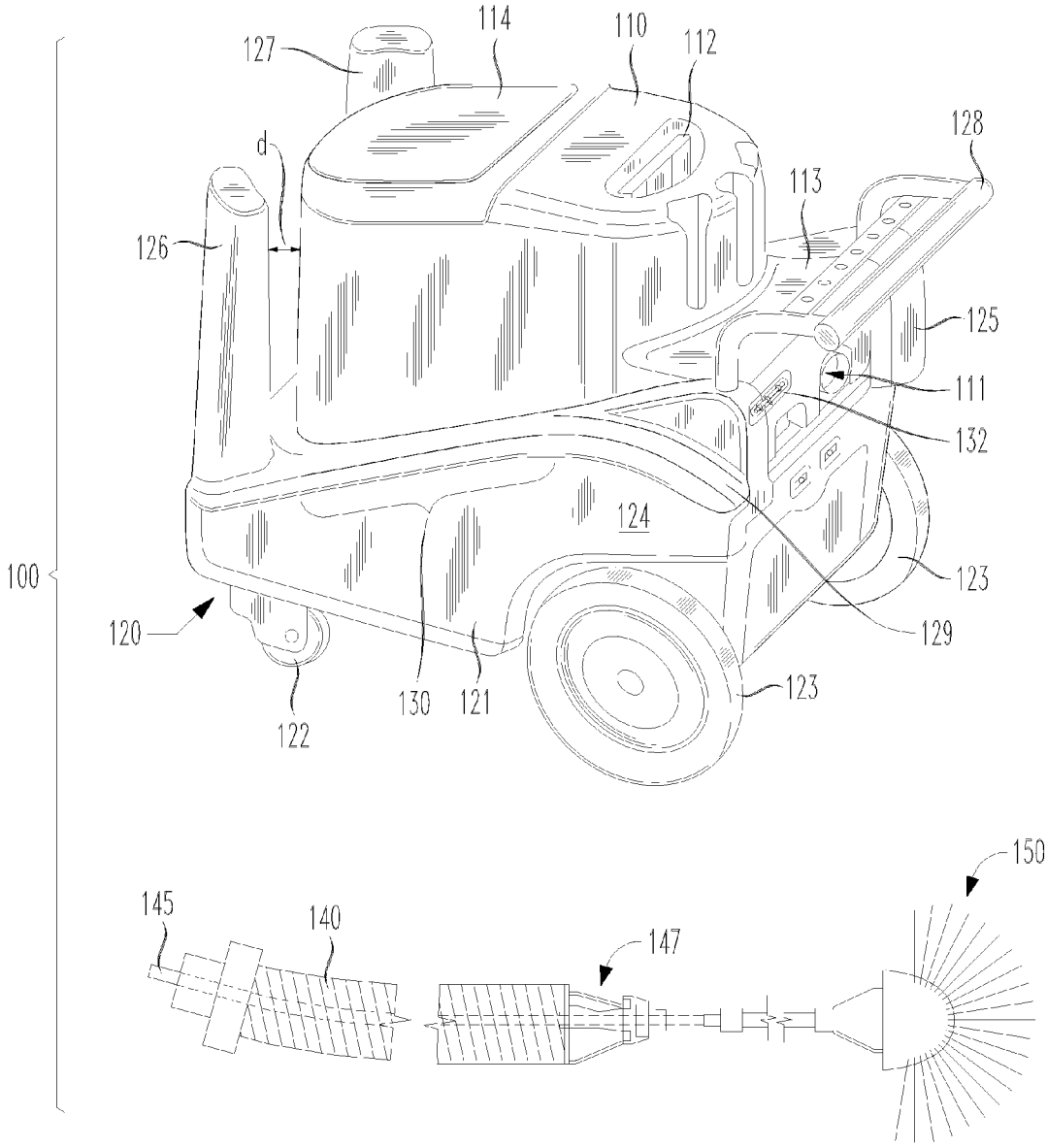
FIG. 1A illustrates a top off-angle perspective view of one embodiment of an improved apparatus for cleaning ducts of a heating/ventilation/air conditioning (HVAC) system.
Figure 1B:
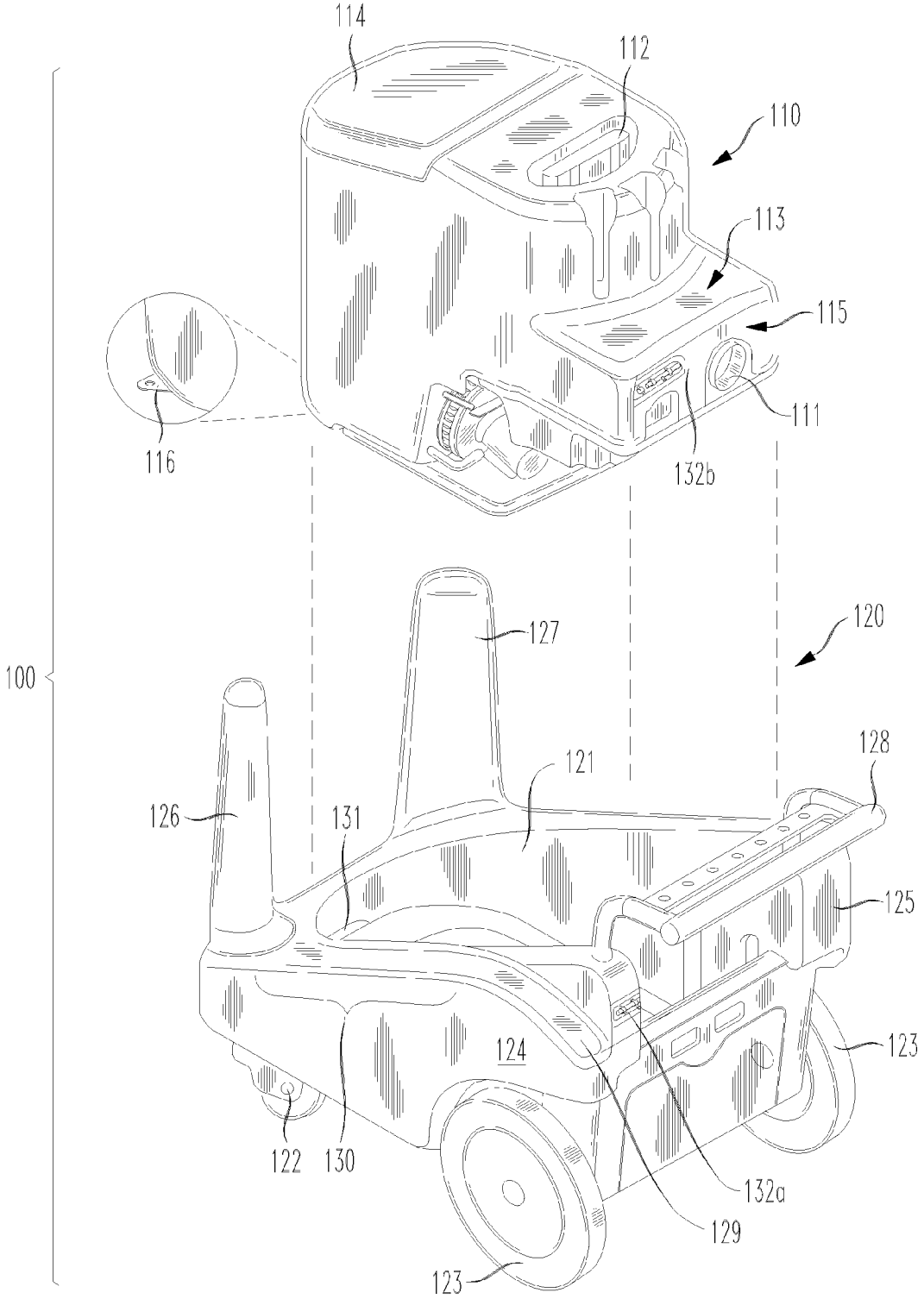
FIG. 1B illustrates an exploded view of the air duct cleaner showing the man-portable pod and the cart individually

Referring initially to FIGS. 1A and 1B, illustrated is a top off-angle perspective view of one embodiment of an improved apparatus 100 for cleaning ducts of a heating/ventilation/air conditioning (HVAC) system. For the purposes of this description, the apparatus 100 will henceforth be referred to as an air duct cleaner 100. It should be understood that while the present discussion is directed to HVAC ducts, the same equipment and principles may also be used to clean other duct systems, e.g., dryer vent ducts, etc. The air duct cleaner 100 comprises two principle elements: a man-portable pod 110, which is easily removable from a cart 120. FIG. 1B illustrates an exploded view of the air duct cleaner 100 showing the man-portable pod 110 and the cart 120 individually. Additionally, a flexible vacuum hose 140 having an internal flexible drive shaft 145, a vacuum nozzle 147, and a generally domal-shaped brush 150, are coupleable to the man-portable pod 110. One who is of skill in the art is familiar with the flexible vacuum hose 140 and brush 150 and their application to duct cleaning.

In a preferred embodiment, the cart 120 is configured to provide rollable conveyance for the man-portable pod 110 and the flexible vacuum hose 140. The cart 120 comprises a cart body 121; forward-mounted caster wheels 122 (only one visible); rear-mounted fixed wheels 123; left and right rear fenders 124, 125, respectively; left and right front posts 126, 127, respectively; a handle 128; a slot 131; and a first portion 132*a* of a latch 132. In one embodiment, the latch 132 may be a barrel bolt. In a preferred embodiment, the cart body 121 is made from a well known durable, light weight molded plastic. In a preferred embodiment, the cart body 121, left and right rear fenders 124, 125, respectively; and left and right front posts 126, 127, respectively; are molded as a single piece. The left rear fender 124 of the cart 120 has a groove 129 on an upper surface thereof. Furthermore, the cart 120 has a declivity 130 from the left rear fender 124 toward the left front post 126 located on a left front corner of the cart 120. Both the groove 129 and the declivity 130 are sufficiently wide to support at least a portion of the flexible vacuum hose 140 for coiled storage. The groove 129 is present on the left rear fender 124 to provide a guide to an operator as the flexible vacuum hose 140 is coiled around the pod 110 while connected to a vacuum inlet 111 of the man-portable pod 110. Likewise, the left and right front posts 126, 127, respectively, are positioned a distance d from the man-portable pod 110 and are spaced sufficiently to receive the vacuum hose 140 therebetween. As such, the pod 110 serves as a storage for the coiled vacuum hose 140, when the man-portable pod 110 is coupled to the cart 120. The vacuum inlet opening 111 is proximate an exterior wall 115 of the man-portable pod 110 and is located higher up the exterior wall 115 than the prior art. This provides a better arrangement of the hose 140 that may now remain coiled about the man-portable pod 110 and enables the air duct cleaner 100 to more conveniently be rolled up and down stairs than the prior art.

In a preferred embodiment, the man-portable pod 110 is also made of the same durable and light weight molded plastic as the cart body 121. The man-portable pod 110 comprises: a handle 112, a rear shelf 113, a top cover 114, a cleat 116; and a second portion 132*b* of the latch 132. The cleat 116 is configured to cooperate with the slot 131 in the forward portion of the cart 120 to help secure the man-portable pod 110 to the cart 120. Furthermore, the first portion 132*a* and the second portion 132*b* of the latch 132 cooperate to removably couple the man-portable pod 110 to the cart 132. The handle 112 is coupled to the man-portable pod 110 structure and configured to enable a technician to lift and carry the man-portable pod 110 unattached from the cart 120, as shown in FIG. 1B. The rear shelf 113 is configured to support at least a portion of the flexible vacuum hose 140 for coiled storage between the man-portable pod 110 and the cart handle 128 when the man-portable pod 110 is coupled to the cart 120. The top cover 114 provides a technician with access to the interior of the man-portable pod 110 for changing disposable elements therewithin.

The unique configuration of the detachable man-portable pod 110 and the cart 120 allows for the man-portable pod 110 to be easily removed from the cart 120 when tight attic spaces or openings have to be navigated. As such, the main vacuum unit can be taken proximate to the plenum so that the maximum length of the duct, limited only by available hose length and not by HVAC system configuration, can be reached. Therefore, the system provides for a more thorough cleaning of the ventilation duct, as well as a time savings. This is in distinct contrast to the conventional units discussed above where, in many cases, the ventilation ducts had to be cleaned from the registers because this unique pod/cart configuration was not previously available in the art.

Figure 2A:
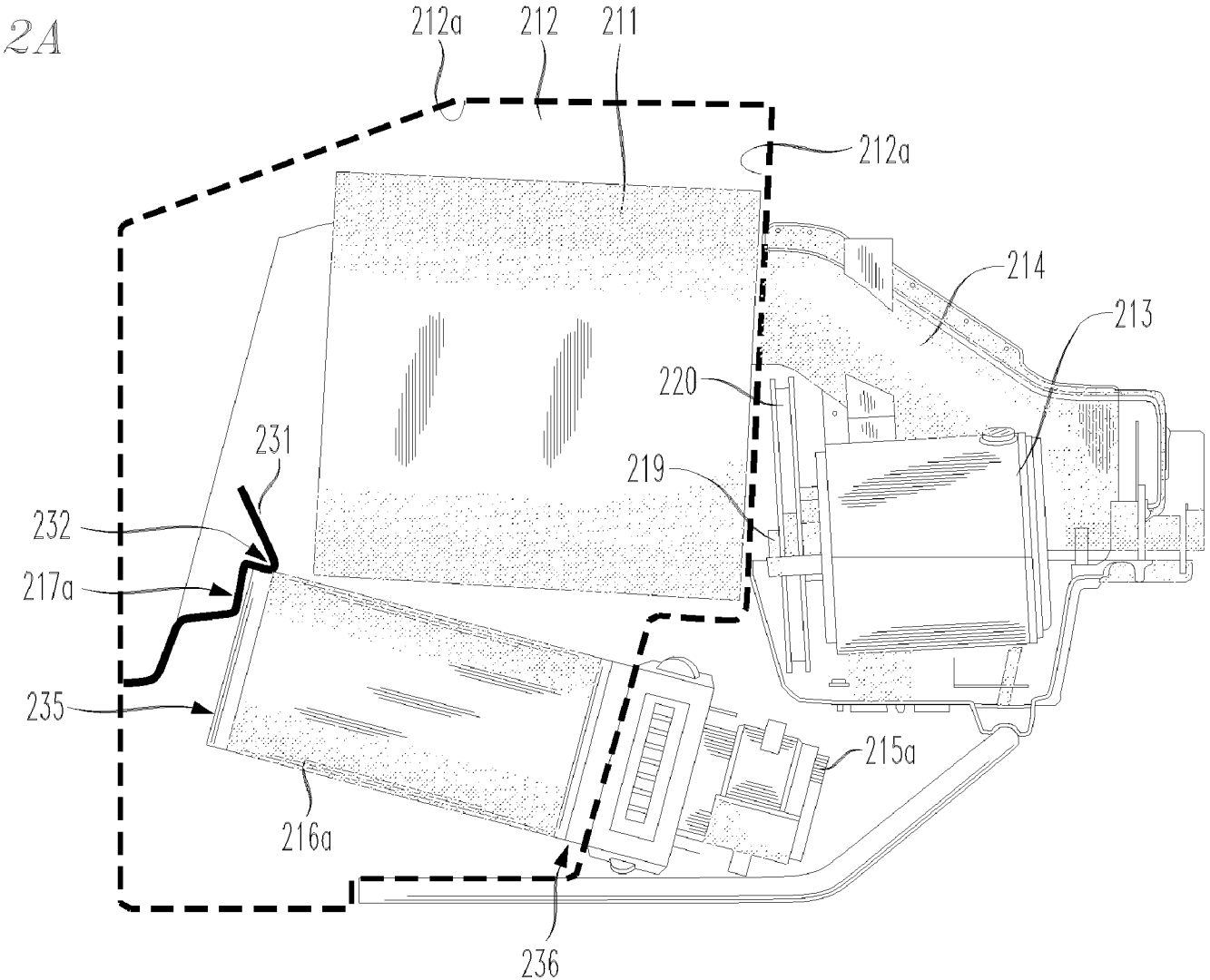
FIG. 2A illustrates a left side view of one embodiment of the major internal elements of the man-portable pod.
Figure 2B:
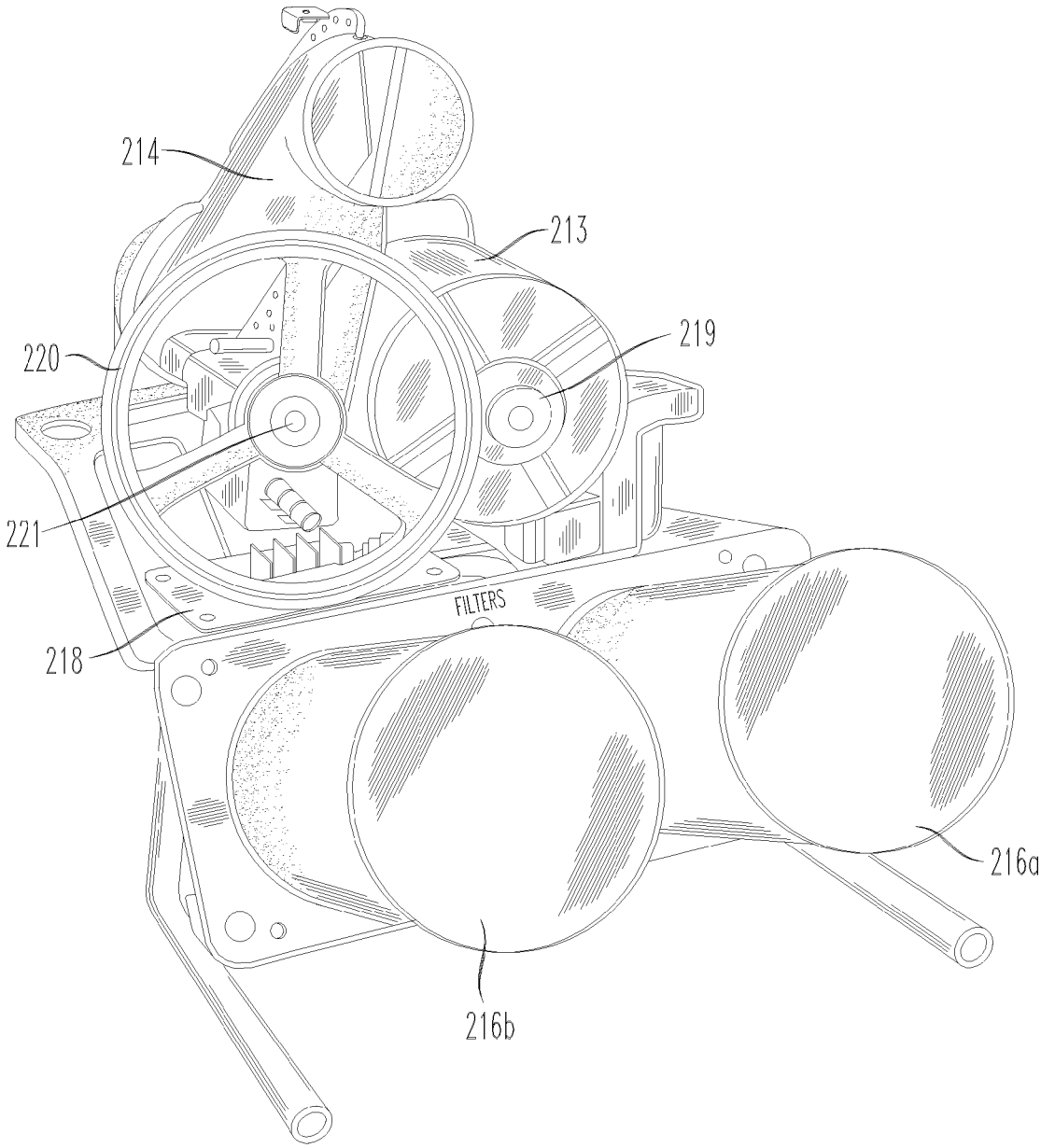
FIG. 2B illustrates a front oblique view of the major internal elements of the man-portable pod of FIG. 2A.
Figure 2C:
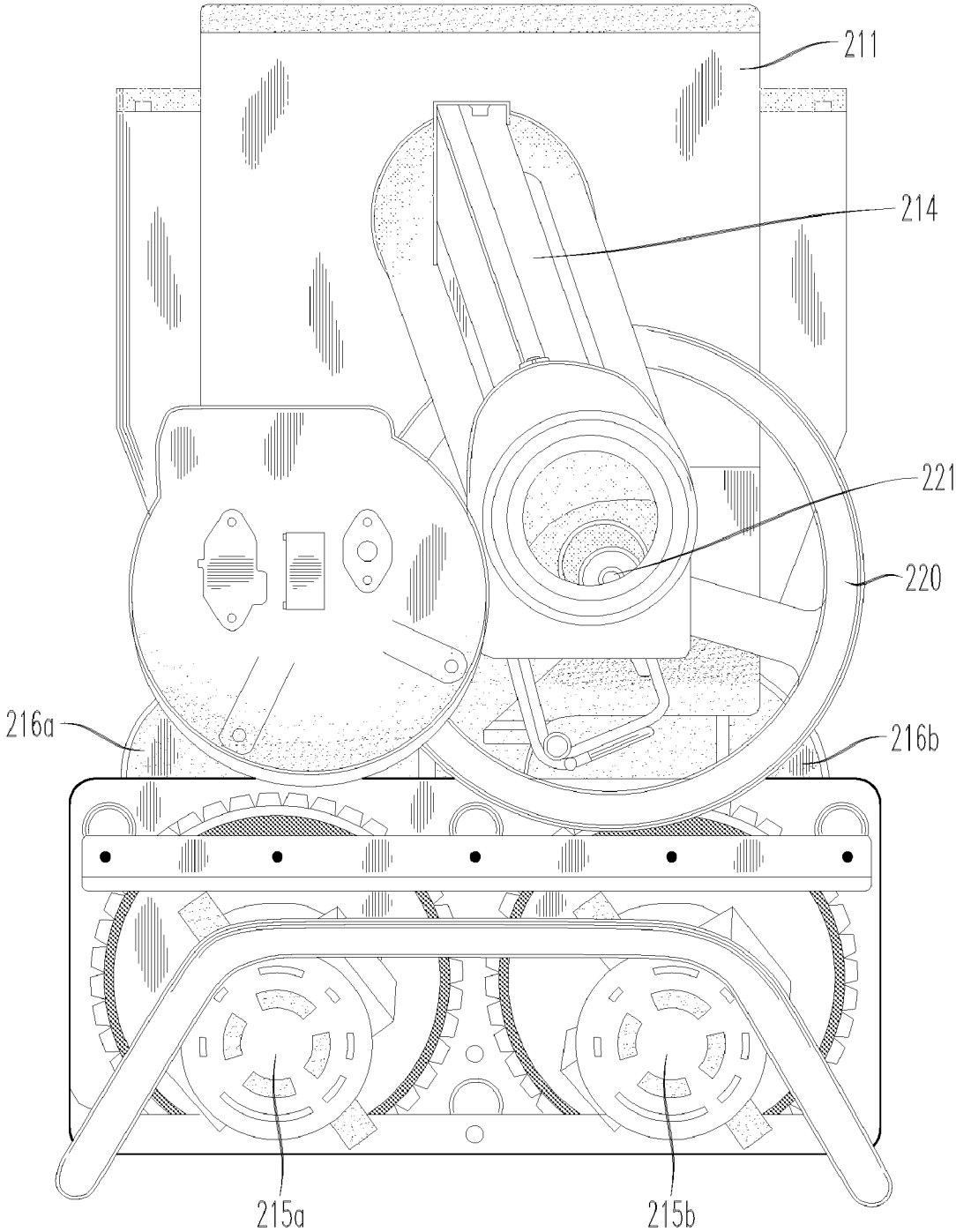
FIG. 2C illustrates a rear view of the major internal elements of the man-portable pod.

Referring now simultaneously to FIGS. 2A-2C. FIG. 2A illustrates a left side view of one embodiment of the major internal elements of the man-portable pod 110. FIG. 2B illustrates a front oblique view of the major internal elements of the man-portable pod of FIG. 2A. FIG. 2C illustrates a rear view of the major internal elements of the man-portable pod 110. Elements of the duct cleaner 100 reside within the man-portable pod 110 (See FIG. 1B). For example, a debris collection bag 211 is positioned in an upper portion of the man-portable pod 110, which makes it easily accessible by way of the top cover 114. The debris collection bag 211 occupies a major portion of a vacuum chamber 212. A drive motor 213 is also located within the man-portable pod 110 adjacent the debris collection bag 211 but the drive motor 213 is separated from the vacuum chamber 212 by a vacuum chamber wall 212*a* .A conduit member 214 extends from an outer wall of the man-portable pod 110 to the debris collection bag 211, and as explained below has a unique configuration that allows for greater air flow, and thus, greater vacuum efficiency.

First and second vacuum motors 215*a*, 215*b* are located underneath the debris collection bag 211 outside of the vacuum chamber and are coupled to first and second filters 216*a*,216*b*, respectively. Moreover, they are configured to create the vacuum in the vacuum chamber 212. The filters 216*a*, 216*b* are held in place by first and second filter catches 217*a* (only the first filter catch 217*a* is visible), which allows for easy removal of the filters from the man-portable pod 110. An electronics control board 218 is strategically positioned under the drive motor 213, which allows air from the vacuum motors 215*a* and 215*b* to cool the electrical components on the board. A friction clutch 219 is coupled to a drive wheel 220 and a drive shaft 221 and these components combine to drive a flexible drive shaft in the vacuum tube that is not shown. Those who are skilled in the art will understand how an end of a flexible drive shaft may be configured to couple to the drive shaft 221. In a preferred embodiment, the drive motor 213 is a bidirectional drive motor 213.

In a preferred embodiment, the two vacuum motors 215*a*, 215*b* are employed in order to increase airflow through the system. The first and second filters 216*a*, 216*b*, are located within the vacuum chamber 214 and are removably coupleable to the first and second vacuum motors 215*a*, 215*b*, respectively. In a preferred embodiment, the first and second filters 216*a*, 216*b* comprise HEPA filters having a high filtering capacity. Additionally, they are one-third larger (longer) than filters used in previous duct cleaning apparatus. This allows for greater airflow through the filters while using the same power of vacuum motor as in previous systems. The first and second filter catches 217*a*, are coupled to the man-portable pod 110 and are located proximate the first and second filters 216*a*, 216*b*. The first and second filter catches 217*a* are configured to hold the first and second filters 216*a*, 216*b*, to the first and second vacuum motors 215*a*, 215*b*, respectively.

Moreover, the filters 216*a*, 216*b* and filter catches 217*a*, 217*b* are configured to enable a technician to rapidly change the filters 216*a*, 216*b*, yet hold the filters 216*a*, 216*b* securely against the first and second vacuum motors 215*a*, 215*b*. The first and second filter catches 217*a*, 217*b* are physically identical and in a preferred embodiment, comprise flat spring steel bent to a profile as illustrated with a tab 231 and a bend 232. Removal of the respective filter 216*a* or 216*b* is accomplished by pulling the tab 231 toward a front of the pod 110 until the bend 232 clears a forward end 235 of the filter 216*a* or 216*b*. The filter 216*a* or 216*b* may then be rotated upwardly and decoupled at a rear end 236 from the respective vacuum motor 215*a* or 215*b*. A new filter 216*a*or 216*b* may then be installed by placing the rear end 236 proximate the respective vacuum motor 215*a* or 215*b* and rotating the new filter 216*a* or 216*b* downwardly until bend 232 snaps into place on the forward end 235.

Figure 3A:
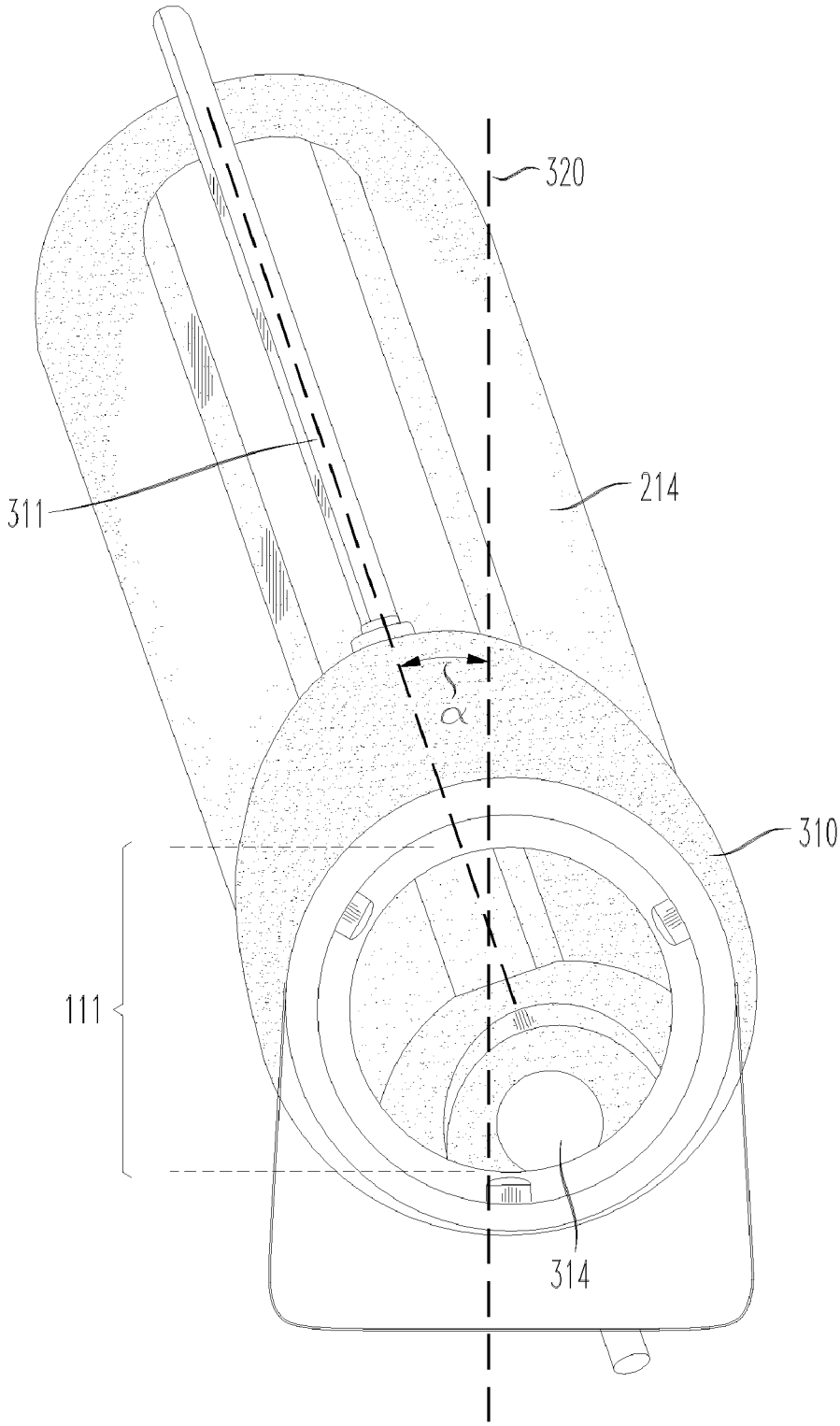
FIG. 3A illustrates a rear elevation view of the conduit member of FIG. 2 including a hose attachment having the vacuum inlet opening therethrough and located at a vacuum hose end of the conduit member.
Figure 3B:
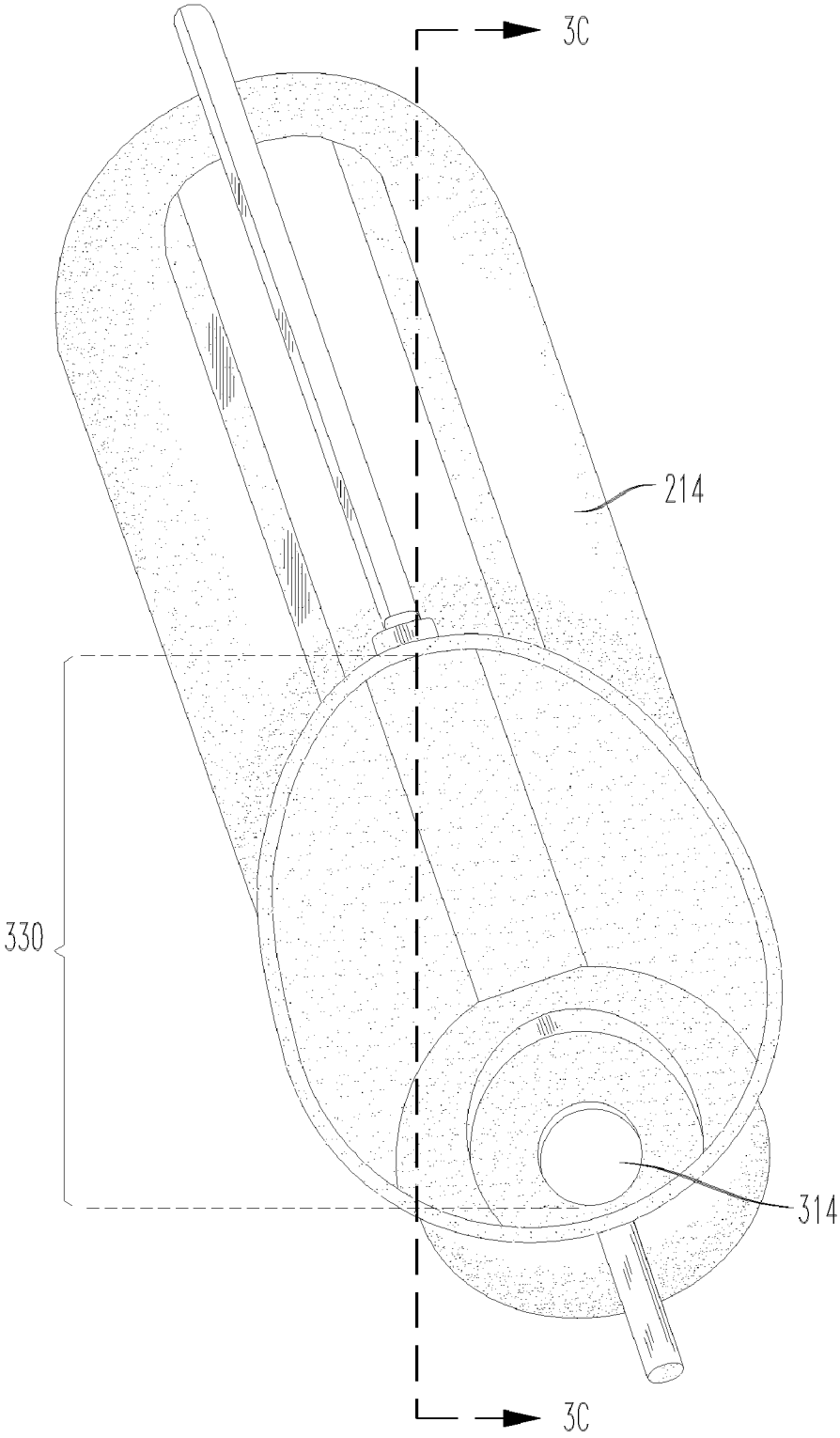
FIG. 3B illustrates a rear elevation view of the conduit member of FIG. 2 with the hose attachment shown in FIG. 3A removed.
Figure 3C:
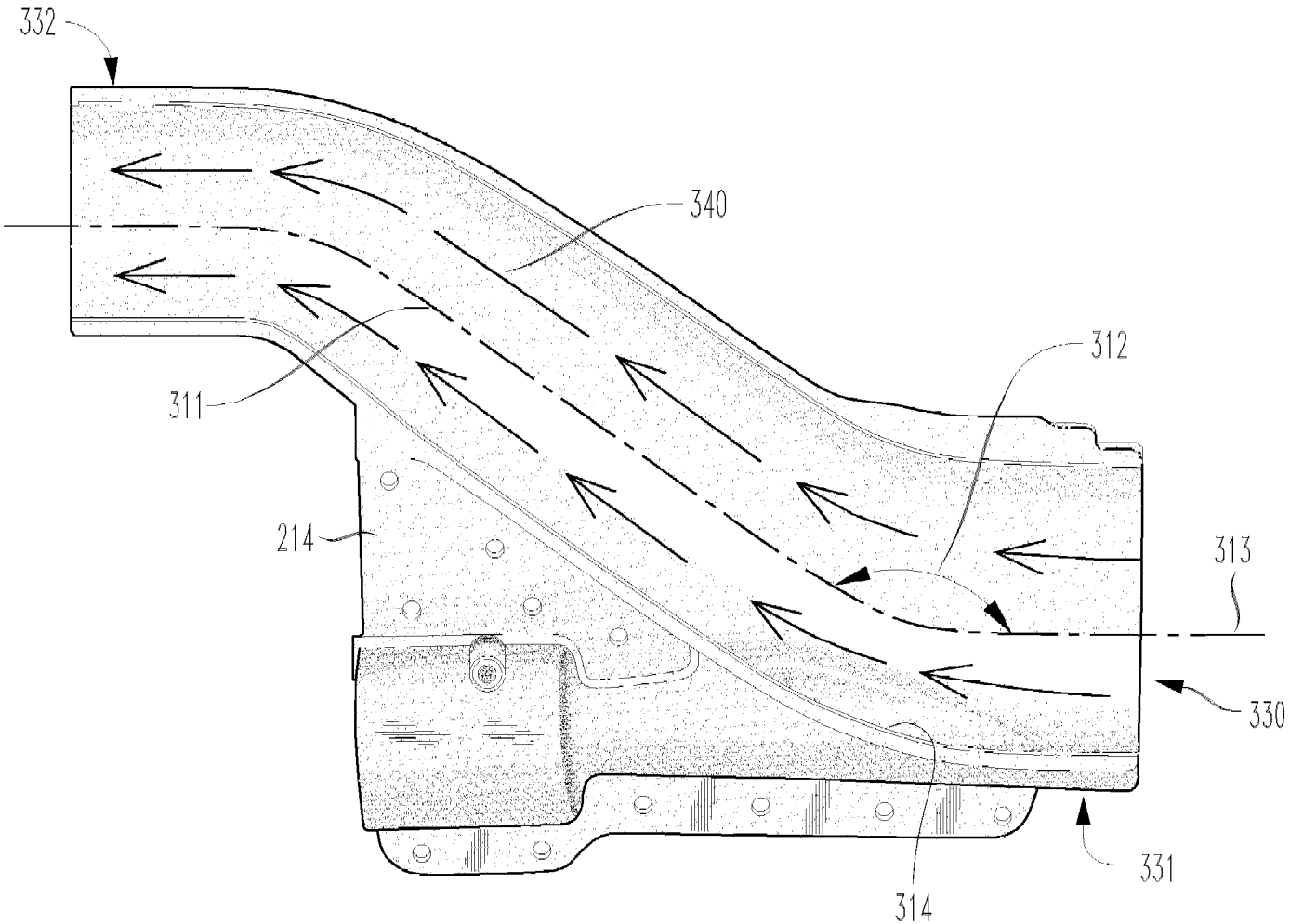
FIG. 3C illustrates a sectional view of the conduit member along plane 3C-3C shown in FIG. 3B.

Referring now simultaneously to FIGS. 3A-3C for various views of the conduit member 214 of FIG. 2. FIG. 3A illustrates a rear elevation view of the conduit member 214 of FIG. 2, including a vacuum hose attachment 310 having the vacuum inlet opening 111 therethrough and located at a vacuum hose end 331 of the conduit member 214. Note that the conduit member 214 lies at an angle a from a vertical reference line 320. FIG. 3B illustrates a rear elevation view of the conduit member 214 of FIG. 2 with the hose attachment 310 shown in FIG. 3A removed. Clearly shown is an opening 330 of the conduit member 214 at the vacuum hose end 331 and proximate the vacuum inlet opening 111. FIG. 3C illustrates a sectional view of the conduit member 214 along plane 3C-3C shown in FIG. 3B. The conduit member 214 also has a vacuum chamber end 332 that is coupleable to the debris collection bag 211.

The conduit member 214 has formed therein an air path 340 that is in fluid communication with the vacuum chamber 212 and has an air path center line 311 that is a curve. The curve forms an obtuse angle 312 taken from a center line 313 normal to the opening 330 and the vacuum inlet opening 111. In a preferred embodiment, the obtuse angle 312 is about 139°, The conduit member 214 also has a drive shaft exit opening 314 formed in the conduit member 214 through which a removable flexible drive shaft (not shown) coupled to a rotatable brush (not shown) can extend. As can be seen in FIGS. 3A and 3C, the air path center line 311 forms a compound curve 311 in that it includes two gently angled turns, as shown in FIG. 3C, and the plane of the centerline 311 is offset from the vertical at an angle $\alpha$. The obtuse angle of the compound curve provides advantages over right-angled prior art configurations in that the curved path allows for a greater airflow, thereby providing for greater vacuum. In addition, the gentle curvature of the conduit member 214 allows for greater component density and strategic location of those components within the man-portable pod 110. For example, the gentle curvature of the conduit member 214 allows for the close placement of the drive motor 213 and drive wheel 220, while, at the same time, providing for a less restricted airflow path within the man-portable pod 110.

The drive shaft exit opening 314 is configured to receive the removable flexible drive shaft of the rotatable brush therein. By forming the conduit member 214 as shown, the flexible drive shaft will exit the conduit member 214 low in the opening 330 as far as possible from the air path centerline 311. This placement, as compared to prior art which exited the flow path at approximately the air path centerline, allows minimal curving of the air path 340 to clear the drive shaft exit opening 314 and the drive wheel 220. Furthermore, as can be seen in FIG. 3B, the conduit member air path opening 330, preferably has an ovoid cross section.

Figure 4:
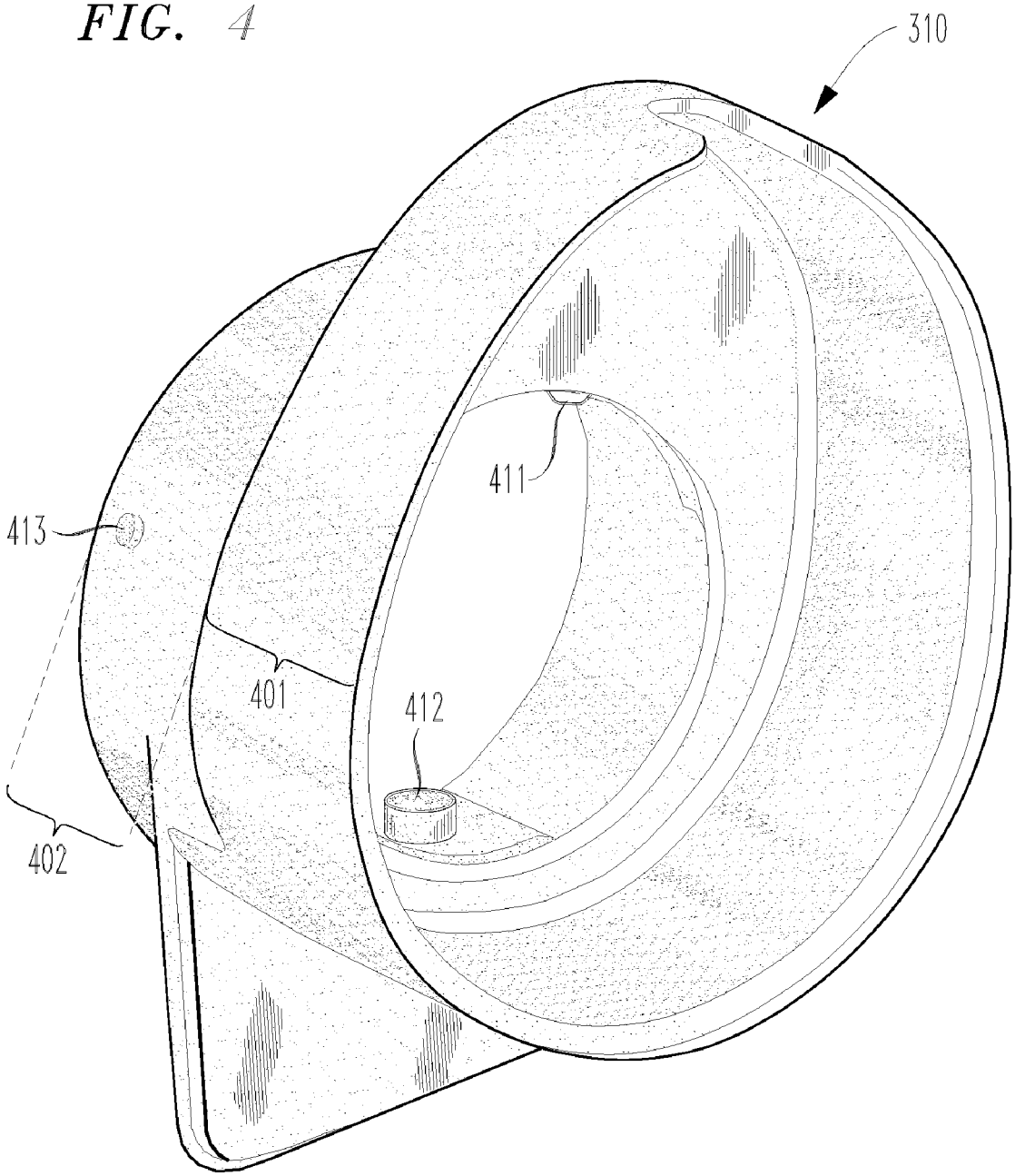
FIG. 4 illustrates a front oblique view of the hose attachment.

Referring now to FIG. 4, illustrated is a front oblique view of the hose attachment 310. The hose attachment 310 has a conduit member end 401 and a hose end 402. The conduit member end 401 has a cross sectional shape necessary to couple to the opening 330 of the conduit member 214 (See FIG. 3B). In the illustrated embodiment, both the cross sectional shape and the opening 330 are ovoid. This contrasts to a circular cross section of the hose end 402. Three rivets 411, 412, 413 enable push-and-twist coupling of the vacuum hose 140 to the hose end 402.

It should be noted that a cross sectional area of the conduit member end 401 is substantially greater than a cross sectional area of the hose end 402. In a preferred embodiment, the cross sectional area of the conduit member end 401 is about two times the cross sectional area of the hose end 402.

Figure 5:
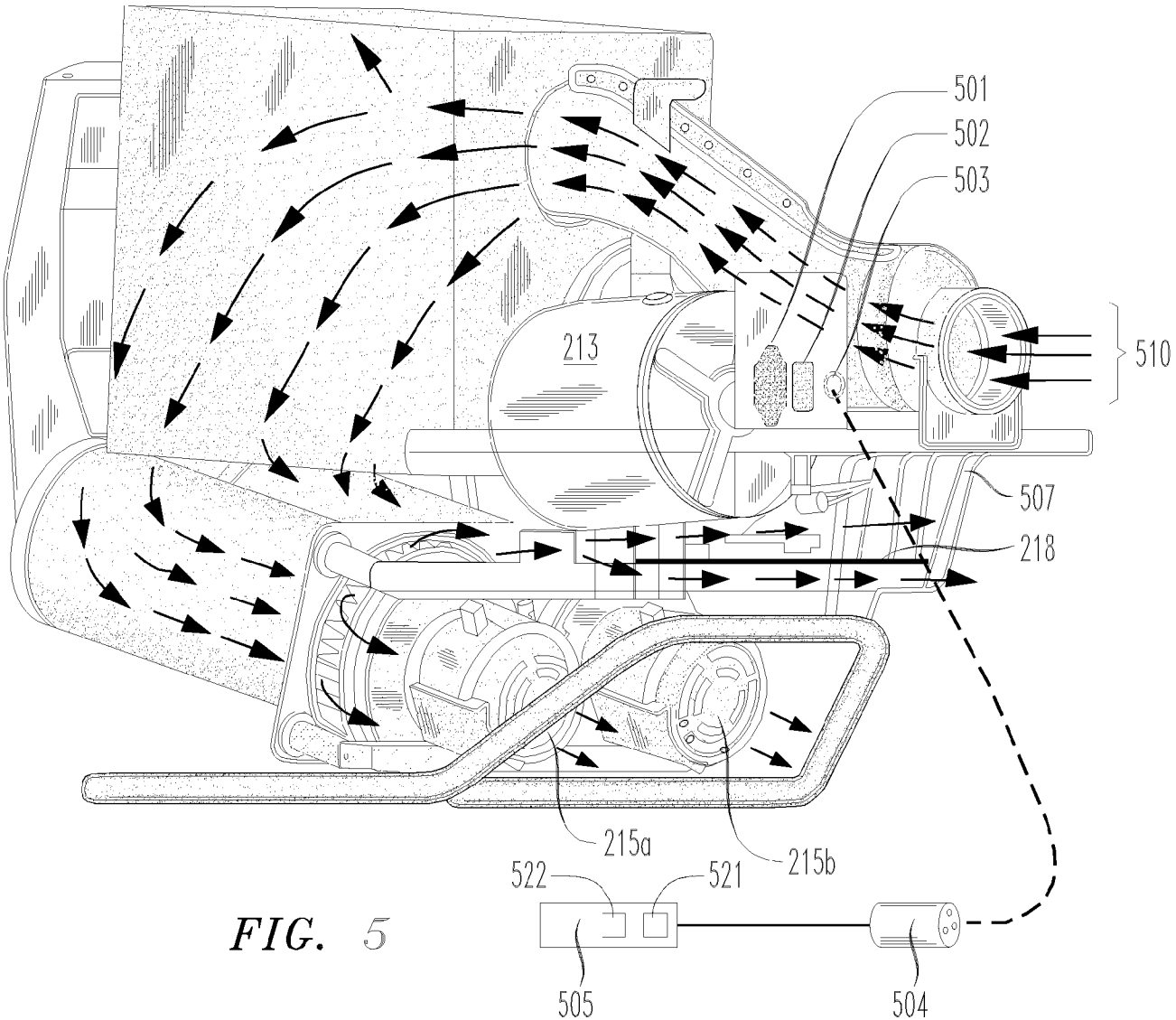
FIG. 5 illustrates a rear oblique view of the major internal elements of the man-portable pod and indicating an airflow path through/around the major internal elements.

Referring now to FIG. 5, illustrated is a rear oblique view of several of the internal elements of the man-portable pod 110. An airflow path 510 is indicated by the arrows through and around the internal elements. The man-portable pod 110 further comprises an AC power connector 501, a master power switch 502, and a mini-DIN receptacle 503. The AC power connector 501 is configured to accept a removable three-conductor 110-115 VAC equipment power cord (not shown for clarity). The mini-DIN receptacle 503 accepts a conventional mini-DIN plug 504 electrically coupled to a remote control 505.

The electronic board 218 is mechanically coupled to a bottom cover 507 of the man-portable pod 110 proximate the drive motor 213 and positioned with respect to the first and second vacuum motors 215*a*, 215*b* to receive cooling air therefrom as shown by the airflow path 510. The electronics board 218 is electrically coupled to: the AC power connector 501; the master power switch 502; the mini-DIN receptacle 503; the remote control 505; the drive motor 213; and the first and second vacuum motors 215*a*, 215*b*, respectively. The remote control 505 uses only low voltage AC, i.e., <1.0 VAC, electrical power derived from the 110/115 VAC power by the electronics board 218. This is in contrast to prior art that routinely uses 110/115 VAC line power at the remote controls if they are so equipped. The use of low voltage AC electrical power is preferred for improved component reliability of the electronics board. The circuitry of the electronic board 218 is configured to power OFF the air duct cleaner 100 if the mini-DIN plug 504 becomes disconnected from the mini-DIN receptacle 503. The air duct cleaner 100 cannot be powered up without connecting the mini-DIN plug 504 to the mini-DIN receptacle 503.

The electronic board 218 is electrically configured to regulate one or more operations of the first and second vacuum motors 215*a*, 215*b* or the drive motor 213. Specifically, the electronic board 218 is configured to start the three motors 213, 215*a*, 215*b* in sequence so that the air duct cleaner 100 can be readily used on commonly available electrical power on lighting circuits of homes and businesses, i.e., 110/115 VAC from a duplex wall outlet rated at 15 amps. One who is skilled in the art is familiar with the fact that electric motors have a higher amperage draw during startup than the amperage required for a steady running state. The electronic board 218 accomplishes sequential startup of the entire system by starting only one motor at a time thereby limiting the startup amperage draw to that of only one AC motor at a time. In most situations, it is advisable to start the vacuum motors first, because if either or both of the vacuum motors are inoperative, it is not desirable to run the drive motor with a brush in a duct to prevent drive cable failure.

In practice, a start switch 521 on the remote control 505 is pushed. This starts a sequence of events on the electronic board 218 that starts the first vacuum motor 215*a* which is sized to be as powerful as possible without exceeding a total current draw of all three motors of 15 amps. When the first vacuum motor 215*a* is running stable, the electronic board 218 automatically continues the startup sequence by starting the second vacuum motor 215*b*. Only when both vacuum motors 215*a*, 215*b* are running stable, does the electronic board 218 enable starting the drive motor 213. After startup, the electronic board 218 is able to keep the total current draw at all times below 15 amps, typically not exceeding 14.09 amps. This prevents repeated tripping of the circuit breaker that would be common if all three, or even any two of the motors were started simultaneously.

The electronic board 218 further includes a drive motor 213 reversing function. That is, the electronic board 218 may be commanded to reverse the rotational direction of the drive motor 213 with a drive motor switch 522 on the remote control 505. The drive motor switch 522 has three positions: ON(CW)-OFF-ON(CCW). As stated above, once the second vacuum motor 215*b* is running normally, the drive motor switch 522 is enabled. Placing the drive motor switch 522 to ON(CW) causes the electronic board 218 to start the drive motor 213 to run with a clockwise rotation. Conversely, placing the drive motor switch 522 to ON(CCW) causes the electronic board 218 to start the drive motor 213 to run with a counter-clockwise rotation. The electronic board 218 has additional circuitry that causes the drive motor 213 to come to a "Full Stop" whenever the drive motor switch 522 is moved to or passes through the OFF position. This prevents the drive motor 213 from being rapidly reversed, or accidentally stopped and then rapidly re-engaged, in order to protect the drive motor 213.

The electronic board 218 further includes a Maintenance Only test kill function. That is, connections on the electronic board 218 to selectively allow start and stop of either of the vacuum motors 215*a*, 215*b*, independently of the operation of the other vacuum motor. This enables a technician to isolate a vacuum motor failure. This function operates independently of the drive motor 213 circuitry and is not accessible with the air duct cleaner 100 in its normal operating configuration.

It should be noted that the combination of: (a) exit location of the flexible drive shaft, (b) increased cross sectional area of the conduit member end 401 versus the hose end 402, (c) less abrupt change of direction of the air path flow, (d) increased size of the HEPA filters 216*a*, 216*b*, and (e) dual vacuum motors 215*a*, 215*b* each individually, and collectively, contribute to an increase in air flow by about 18 to 20 percent at the hose nozzle 147 (See FIG. 1A), thus improving vacuum efficiency significantly.

Figure 6:
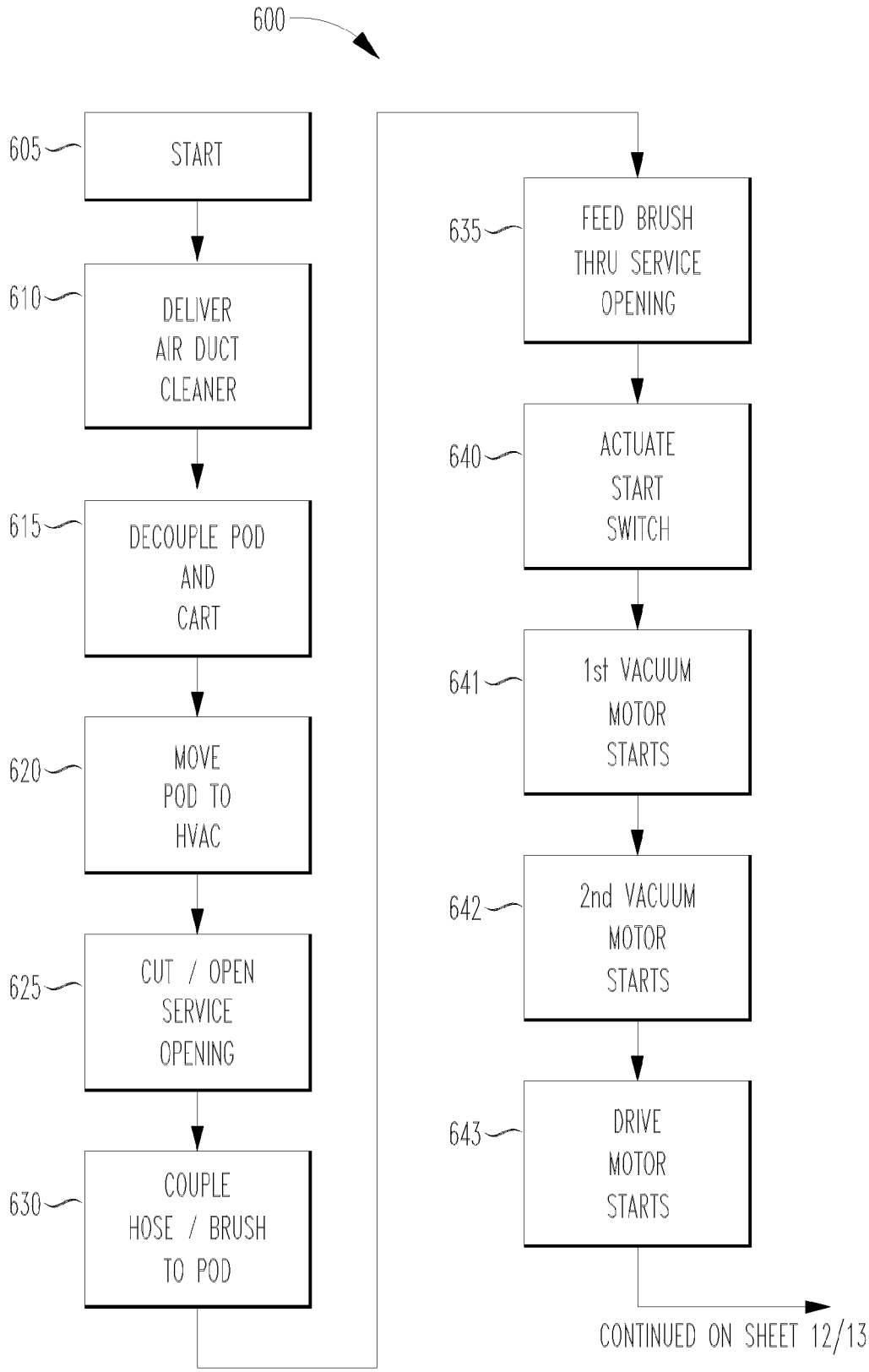
FIG. 6 illustrates a flow diagram for a method of cleaning a residential/commercial HVAC system having an outflow plenum.
Figure 6:
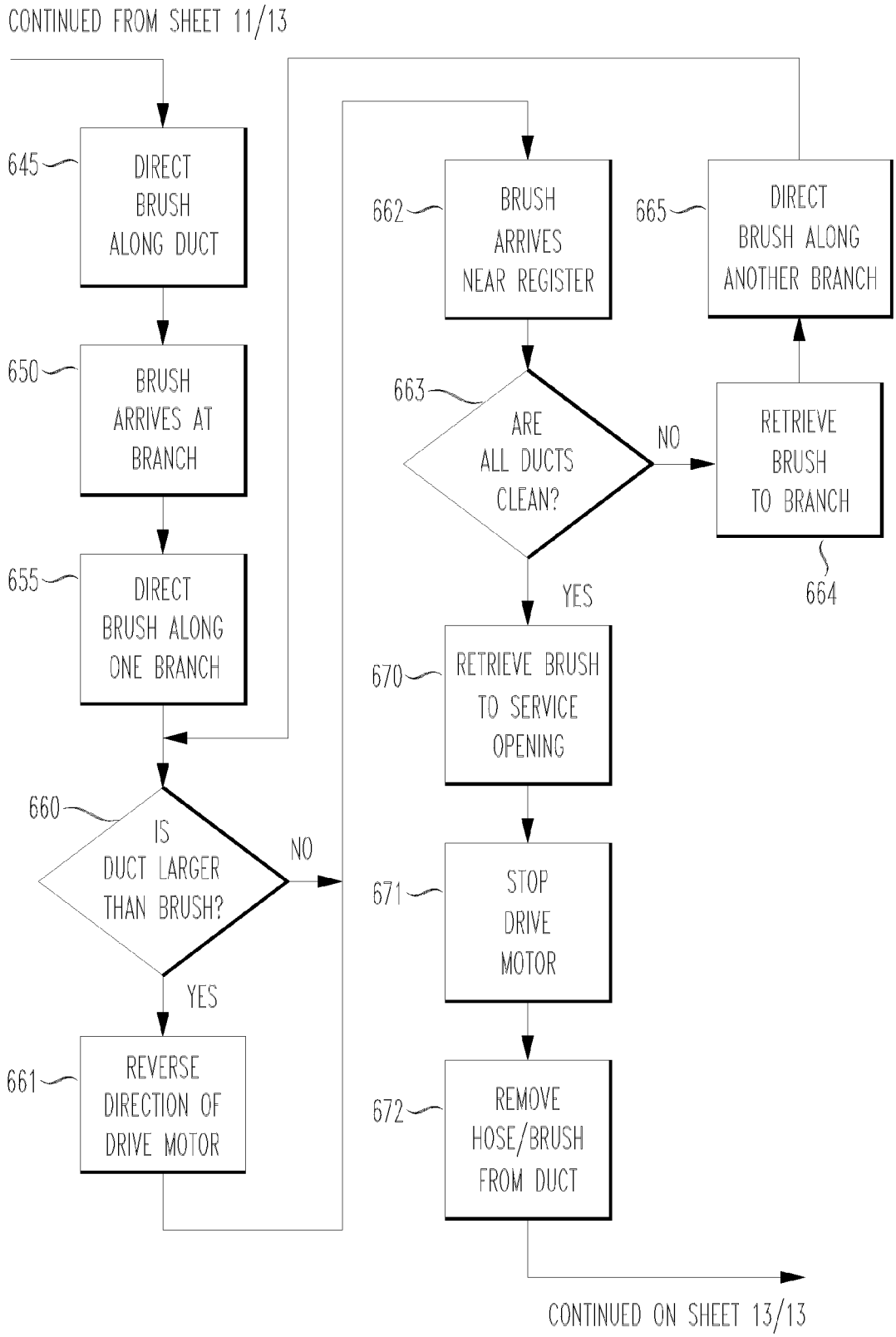
Figure 6:
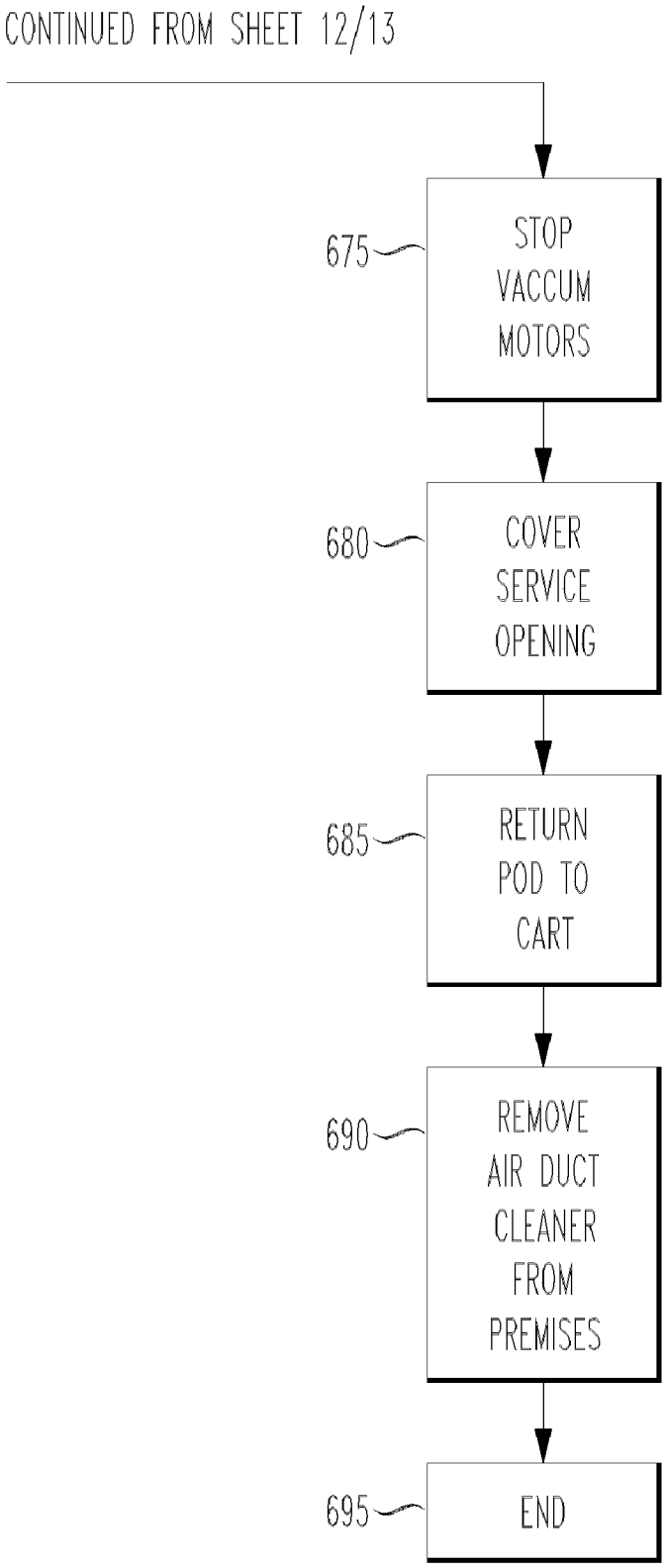
Figure 1A:
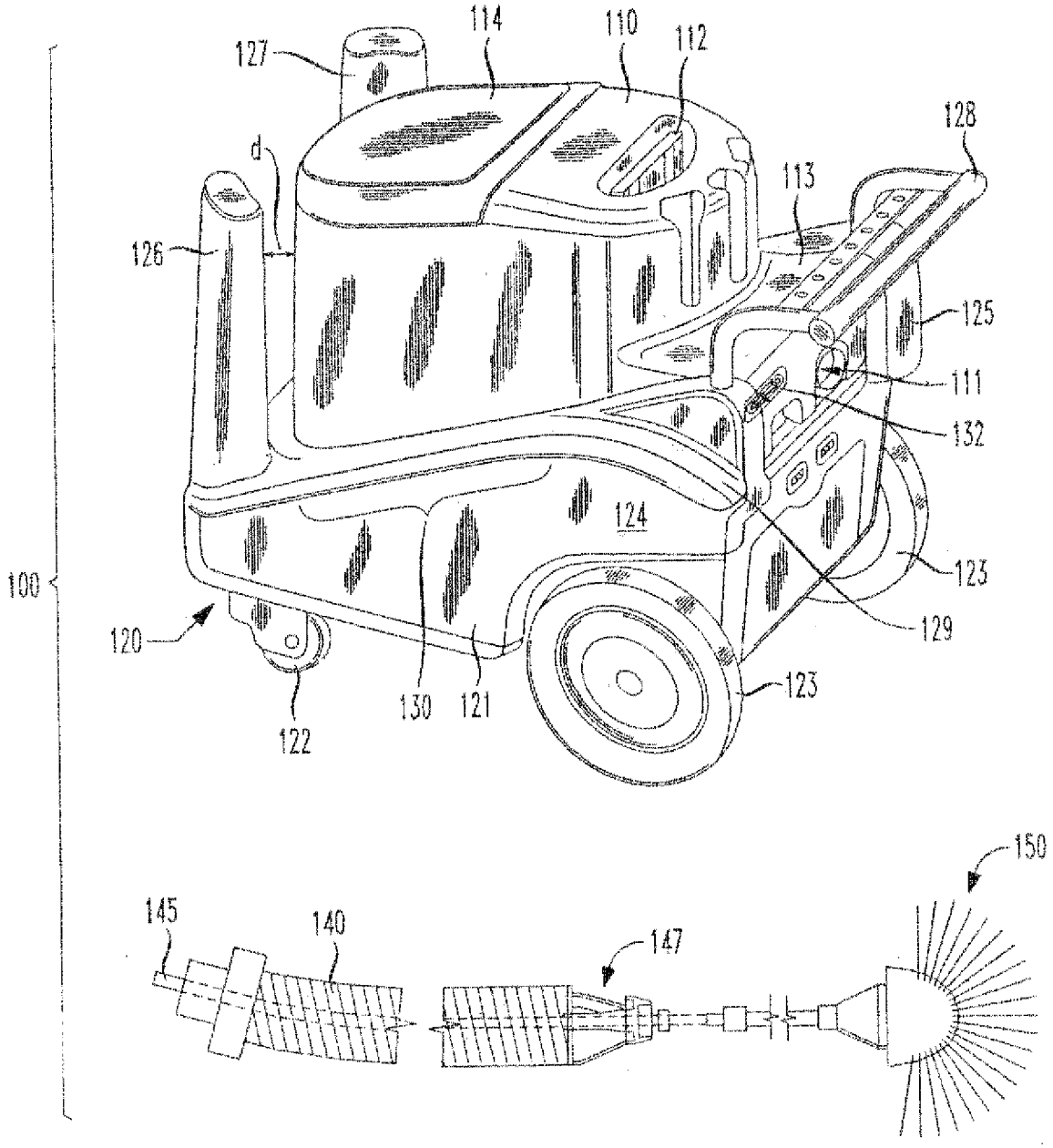
Figure 1B:
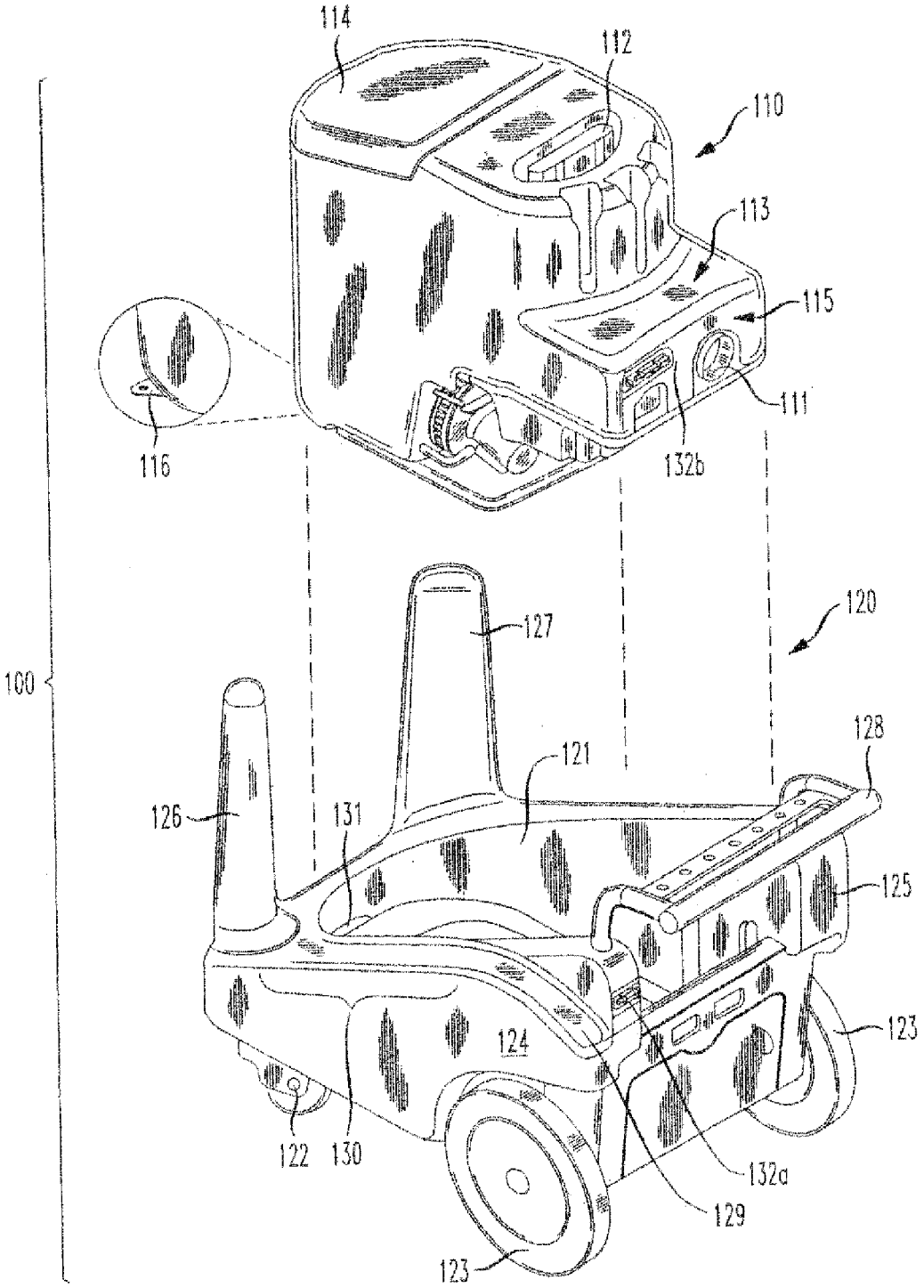
Figure 2A:
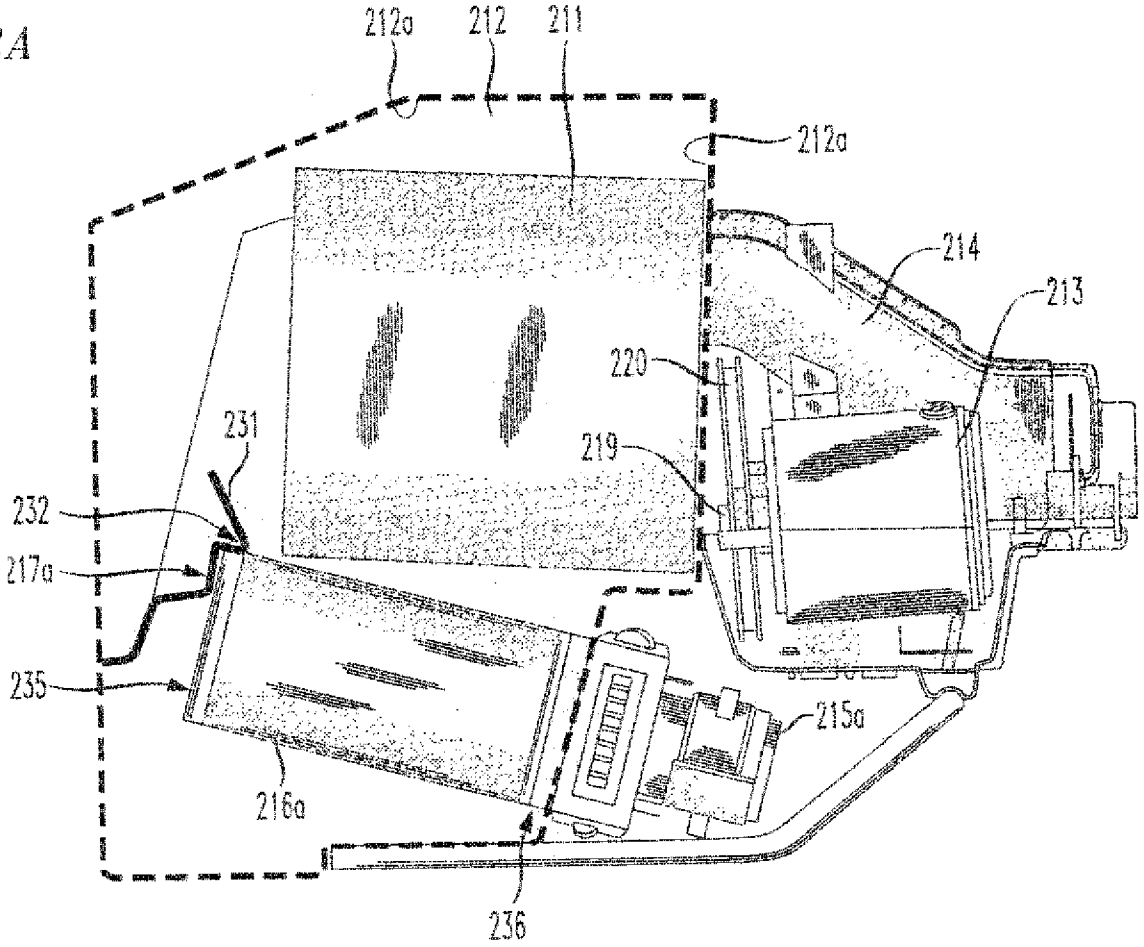
Figure 2B:
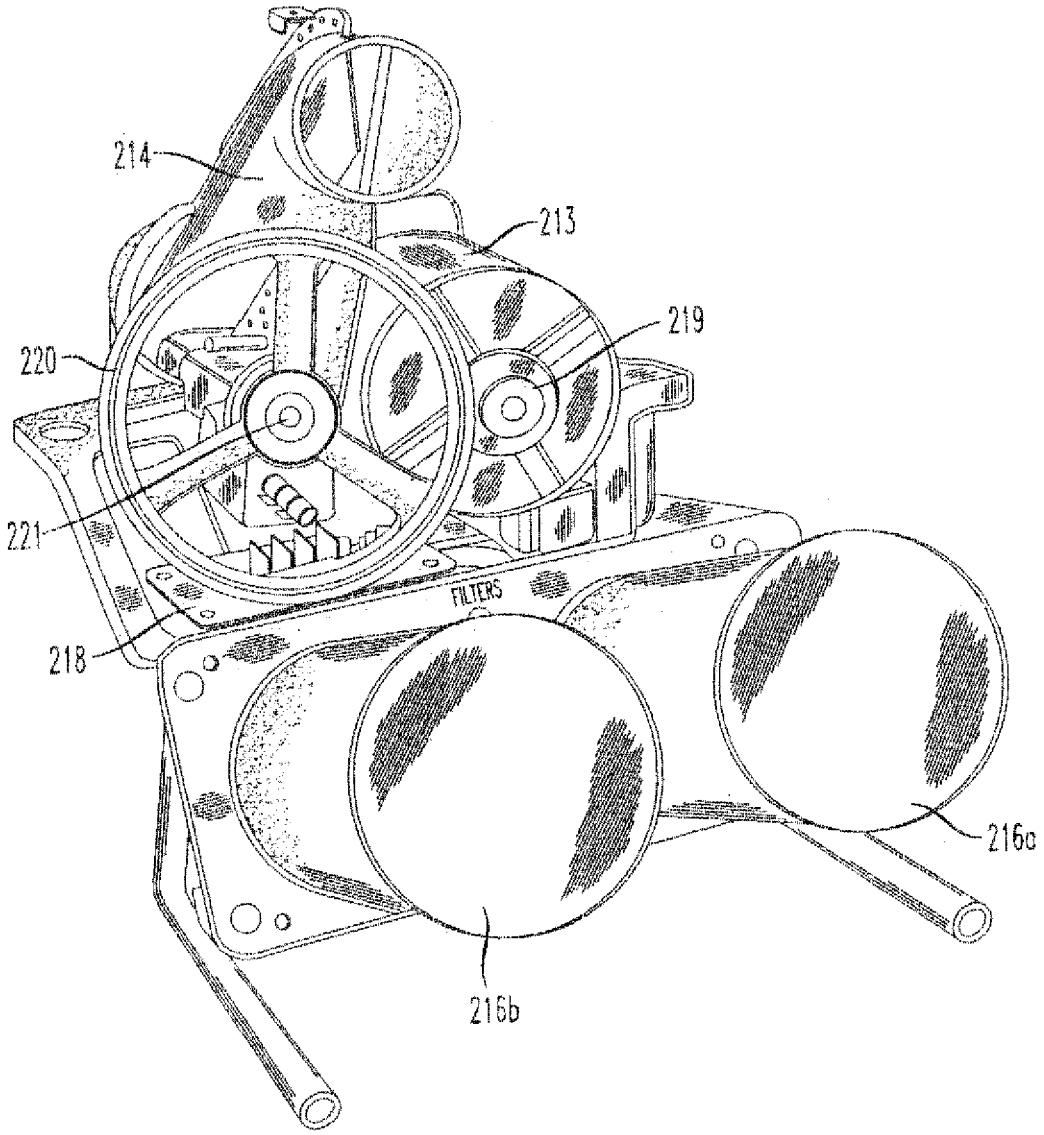
Figure 2C:
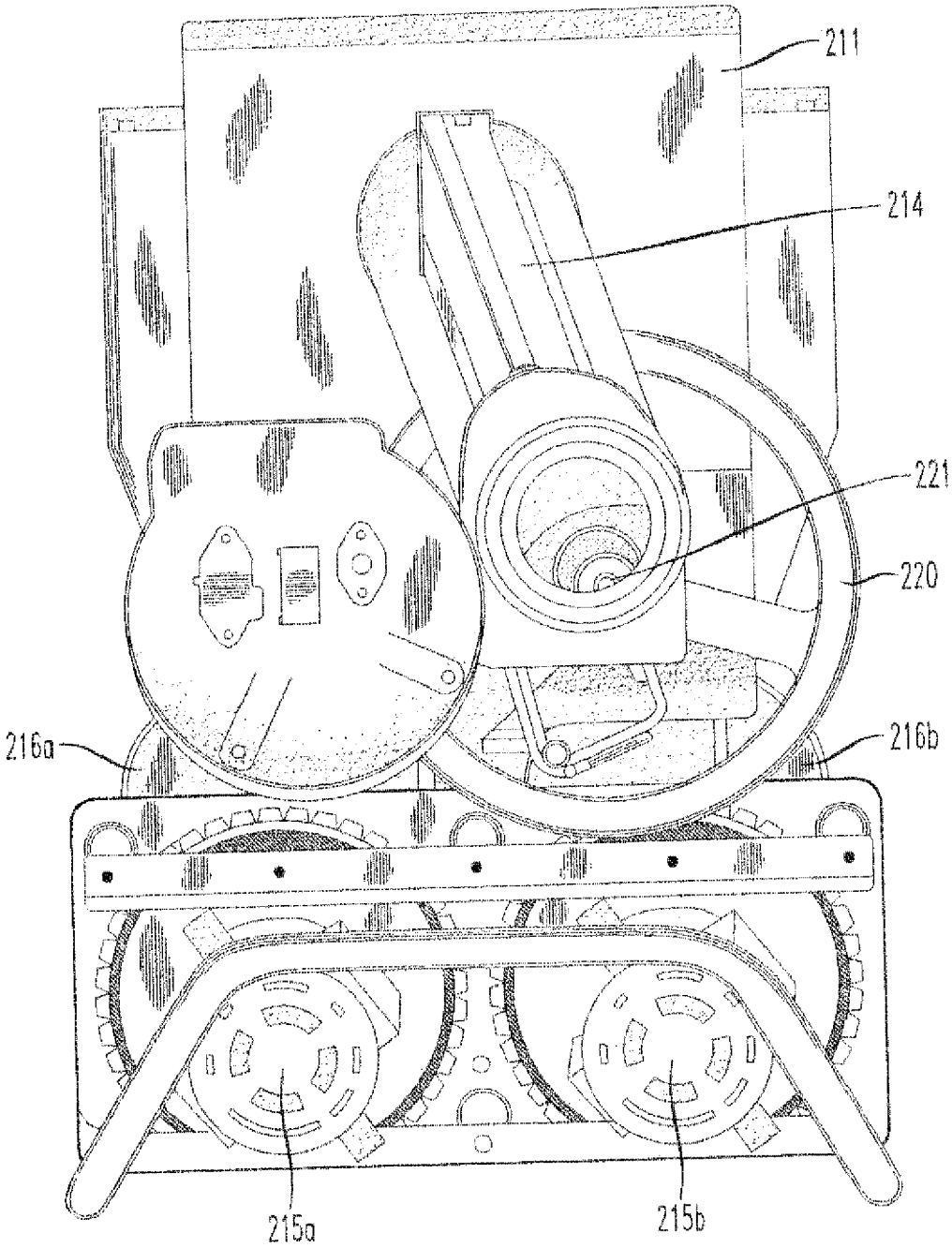
Figure 3A:
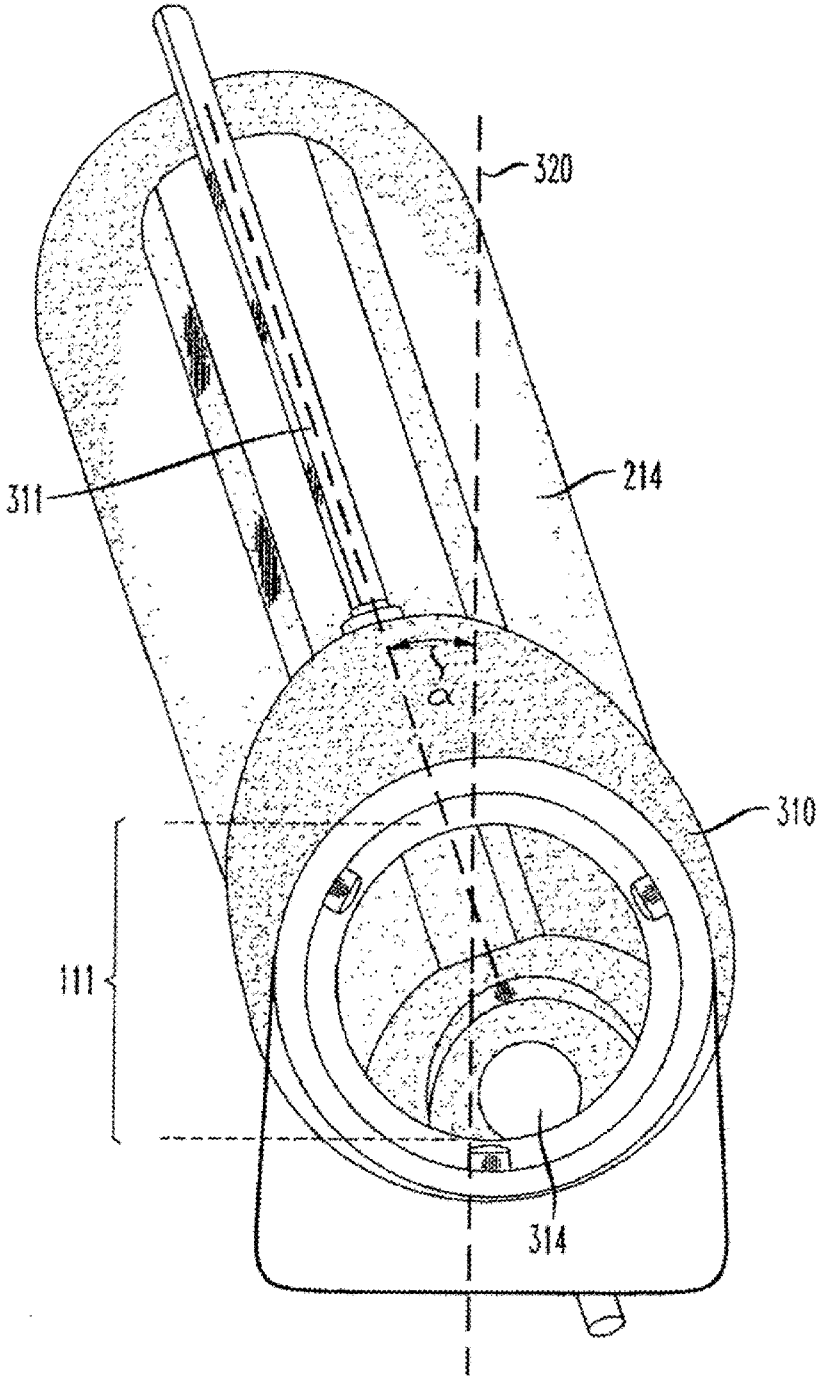
Figure 3B:
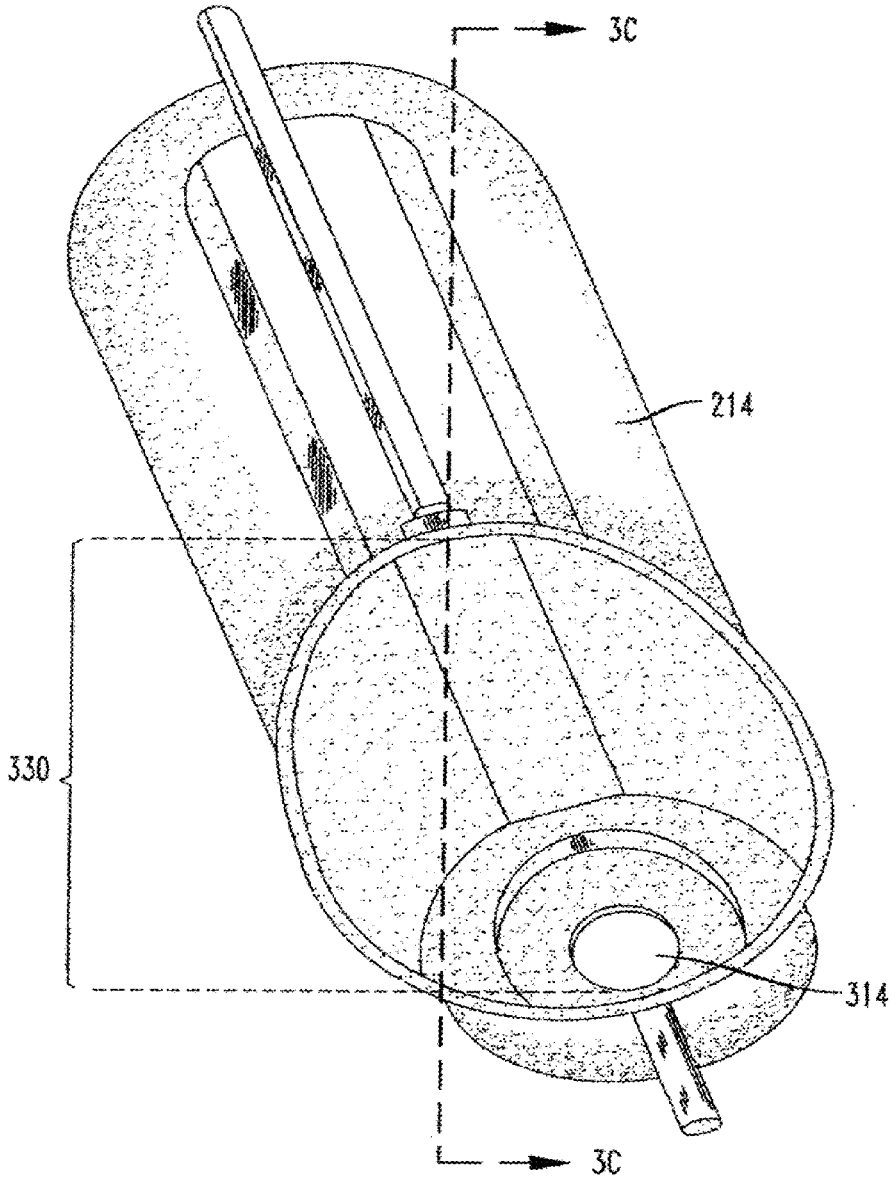
Figure 3C:
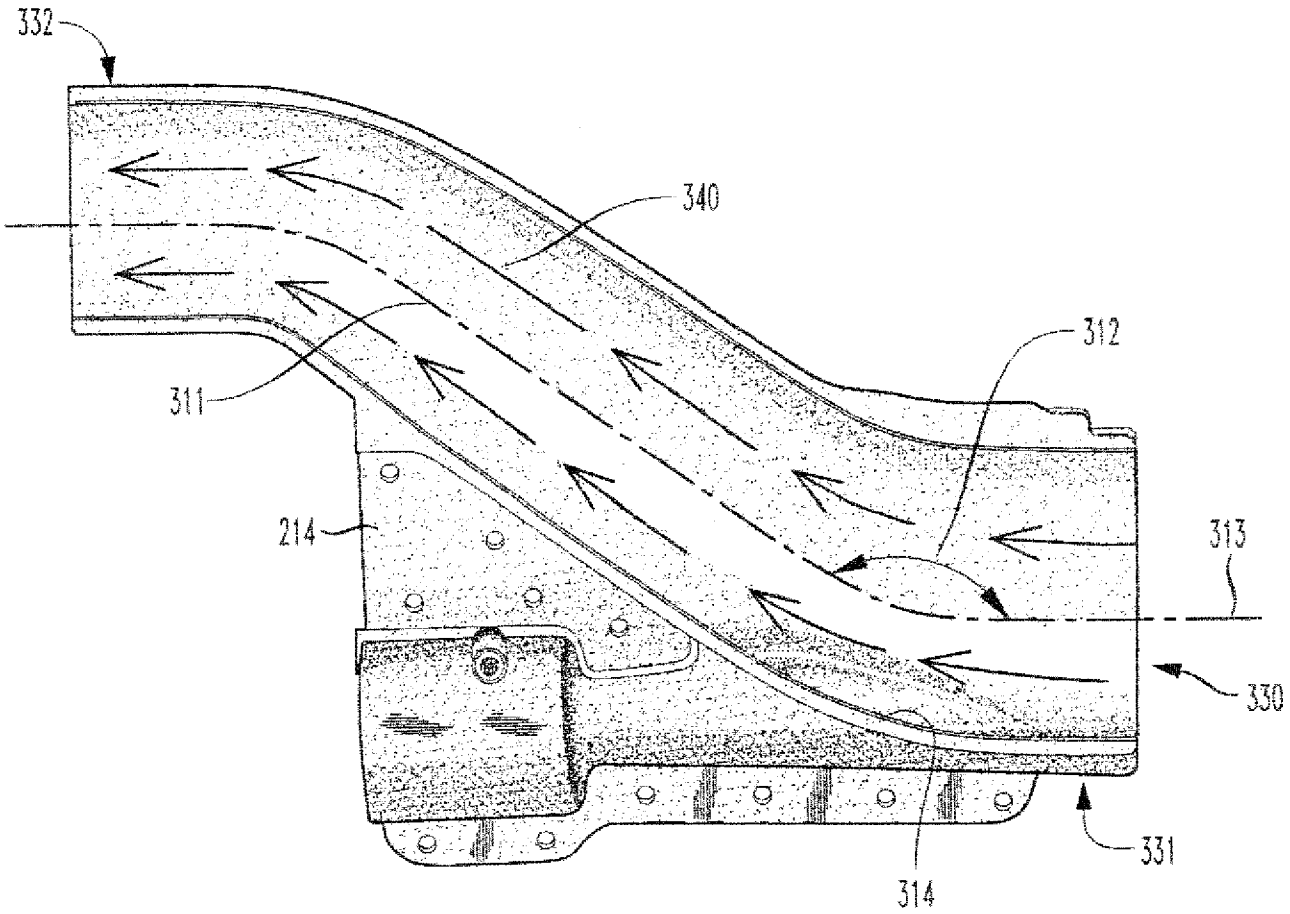
Figure 4:
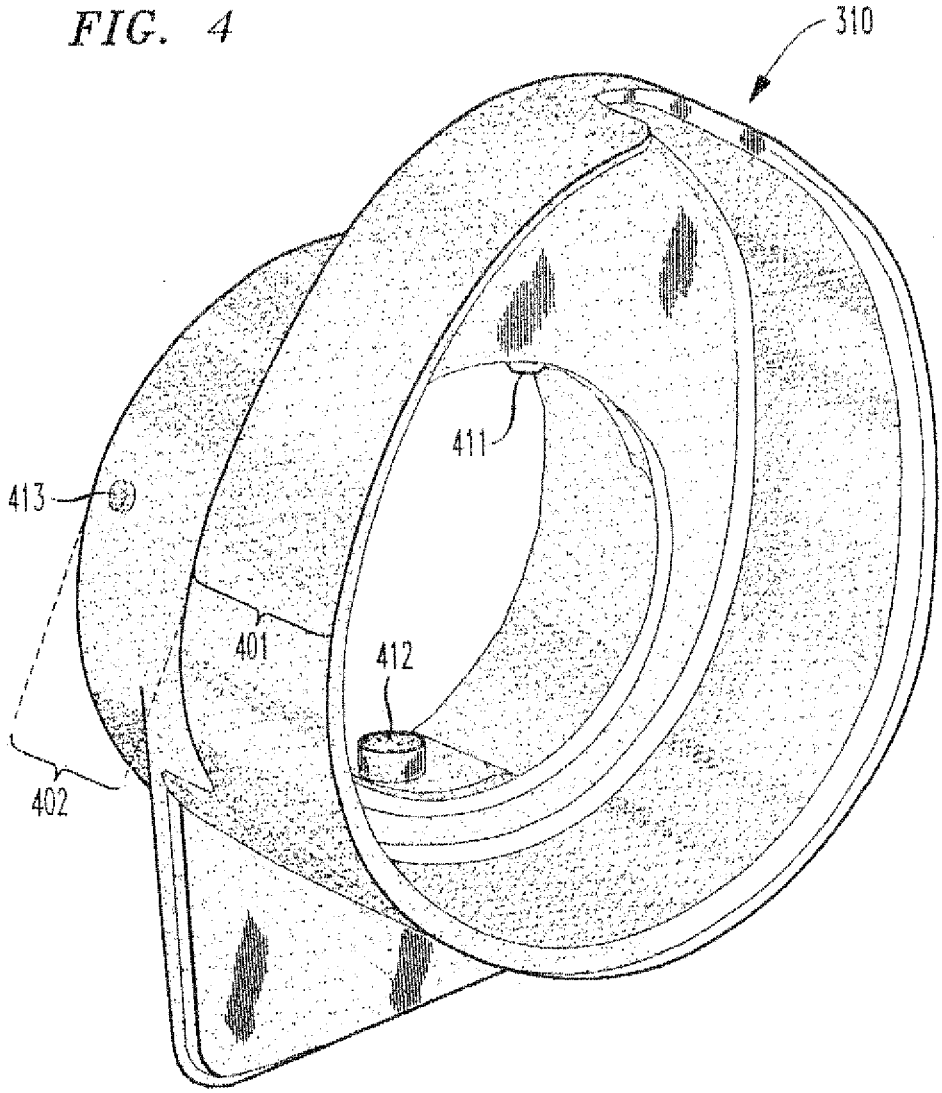
Figure 5:
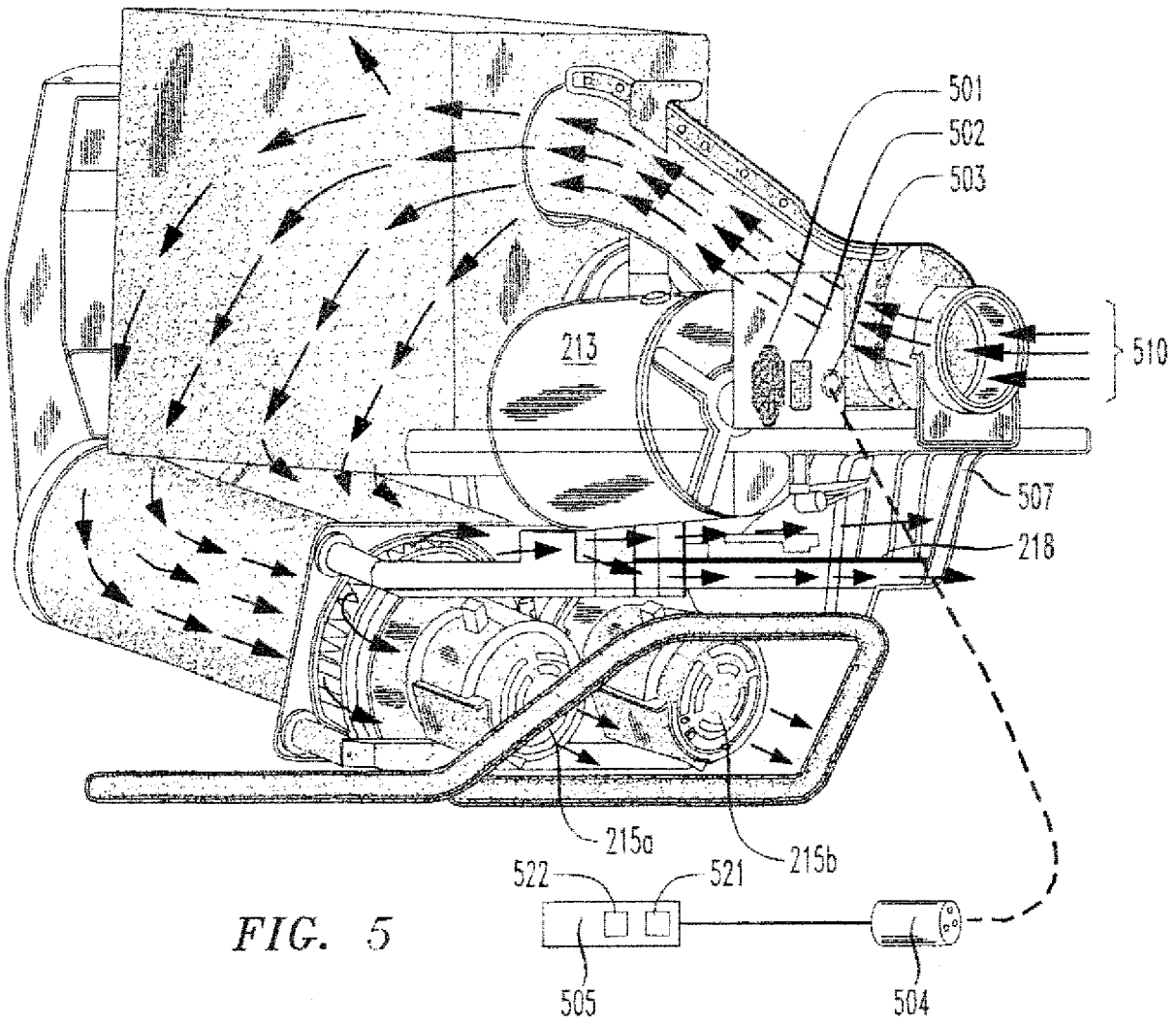
Figure 6:
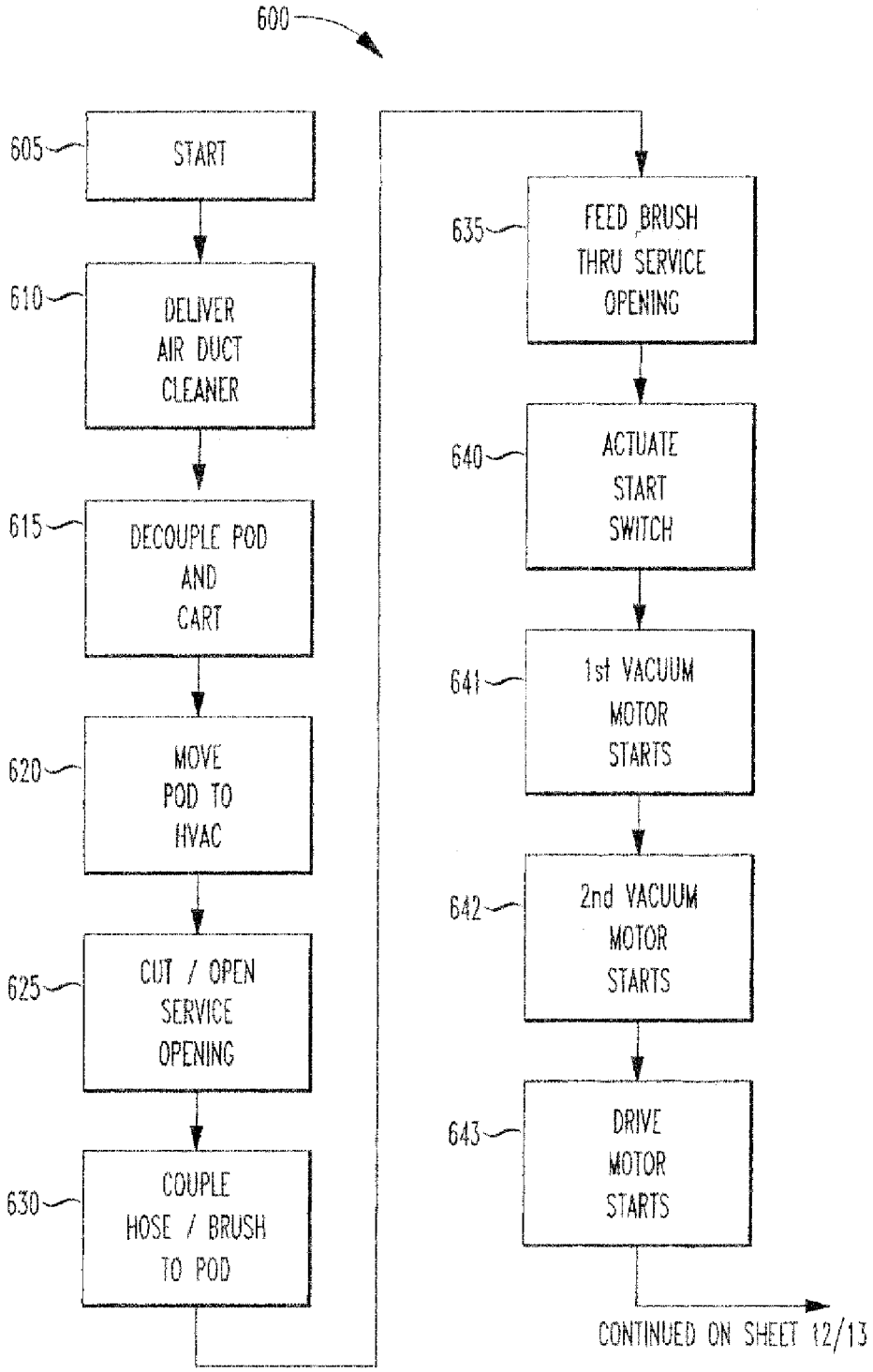
Figure 6:
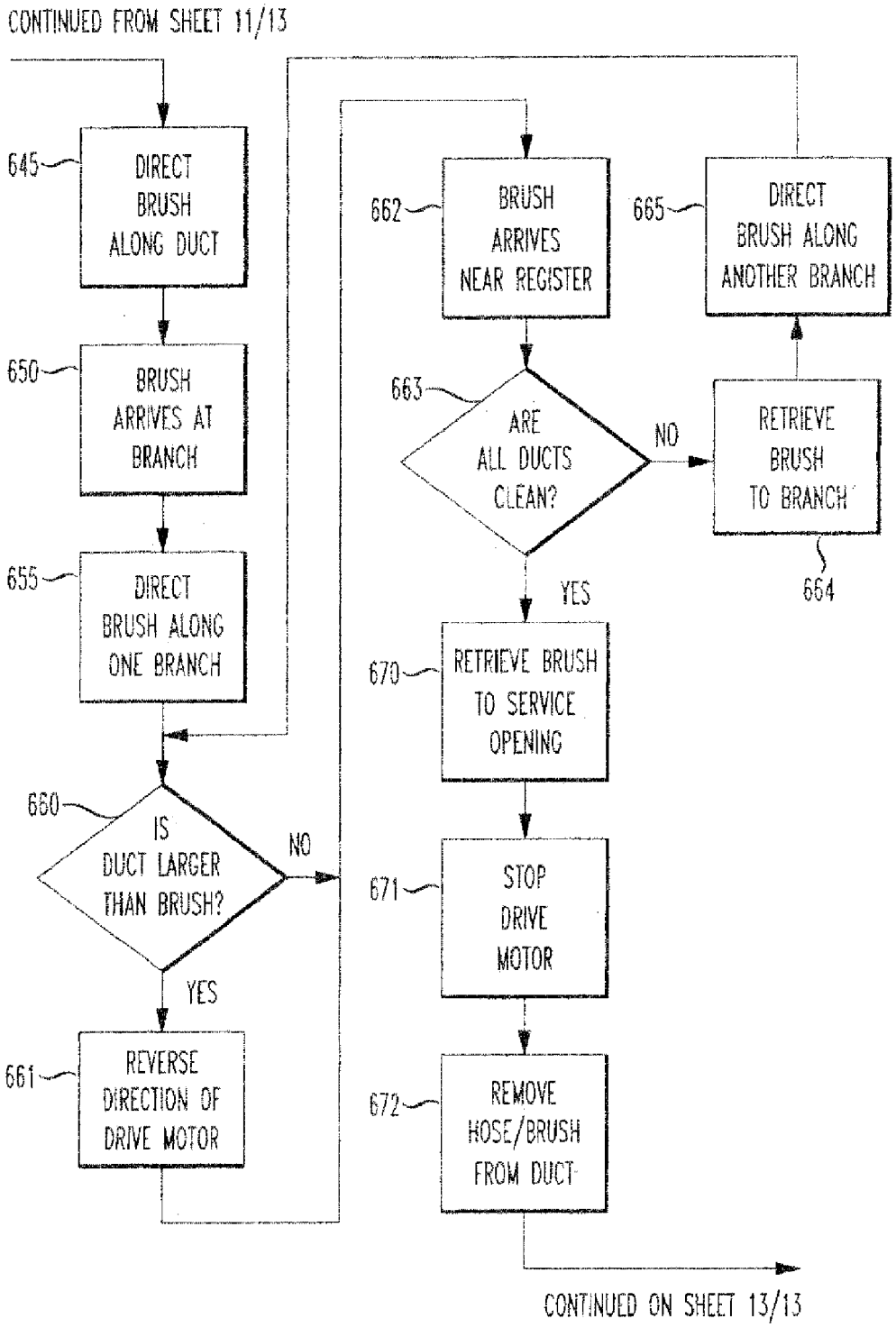
Figure 6:
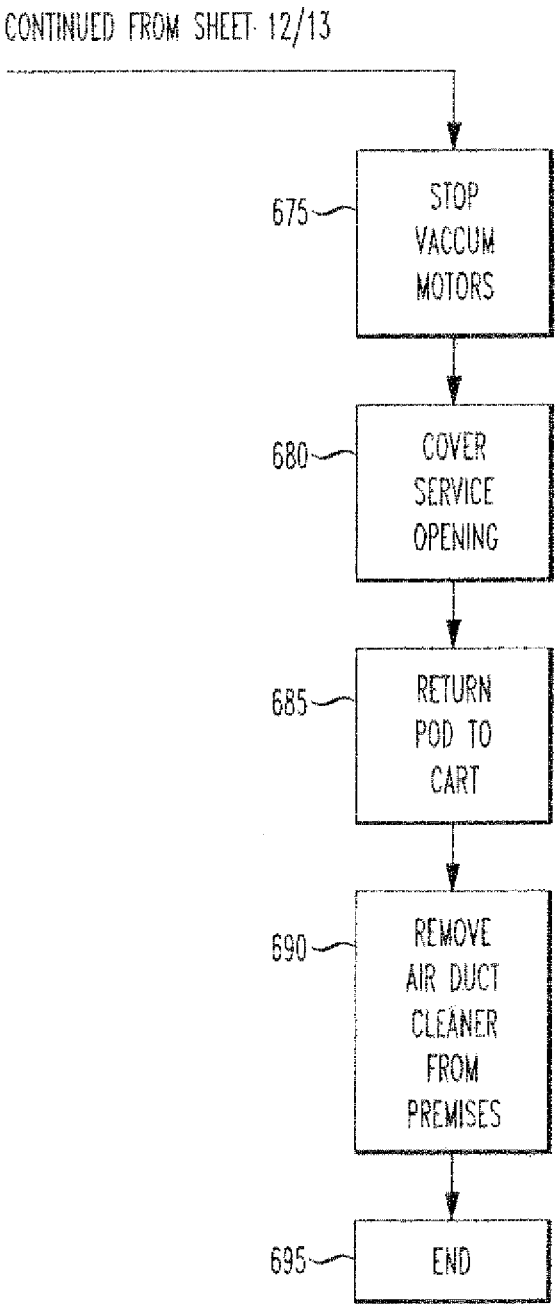

It should be noted that the present invention may be used while the man-portable pod 110 is coupled to the cart 120. However, a preferred method of operation of the air duct cleaner 100 is to clean a duct system from the vicinity of the main outflow plenum of an HVAC system prior to the first branching of the ducts. Referring now to FIG. 6 with continuing reference to FIGS. 1A through 5 as required, illustrated is a flow diagram 600 for a method of cleaning a residential/commercial HVAC system 600 having an outflow plenum.

The method begins at Start Step 605. At Step 610, the air duct cleaner 100 is brought to the site having the HVAC system. At Step 615, the man-portable pod 110 is decoupled from the cart 120. At Step 620, the man-portable pod is positioned proximate the outflow plenum of the HVAC. At Step 625, a service opening is cut or opened in the outflow plenum. At Step 630, a flexible vacuum hose 140 with an internal flexible drive shaft 145 and attached rotary brush 150 is coupled to the vacuum inlet 111 and to the drive shaft 221 of the man-portable pod 110. At Step 635, the rotatable brush 150 and portions of the flexible vacuum hose 140 and internal flexible drive shaft 145 are fed into the outflow plenum through the access hole. At Step 640, the Start Switch on the remote control is actuated.

At Step 641, the first vacuum motor 215*a* starts. At Step 642, the second vacuum motor 215*b* starts thereby making full system vacuum available. At Step 643, the drive motor 213 is started, thereby rotating the rotatable brush. At Step 645, the flexible vacuum 140 and internal flexible drive shaft 145 are directed along the outflow duct collecting debris from inside of the duct and directing the debris along the flexible vacuum hose 140 to the collection bag. At Step 650, the rotatable brush 150 arrives at a branch in the duct. At Step 655, the rotatable brush 150 is directed along one branch of the duct system.

At Step 660, the operator decides if the duct being cleaned is substantially wider than the brush. If the answer is YES, then the method moves to Step 661 where the drive motor direction is reversed to cause the brush 150 to work against an opposite wall of the duct until Step 662 when the brush arrives near an outlet register. If the answer is NO, the method proceeds until step 662 when the brush 150 arrives proximate the outlet register. At Step 663, the operator decides if all of the ducts have been cleaned. If the answer is NO, then the operator retrieves the brush 150 back to the previous branch of the duct. At the branch and Step 665, the operator directs the brush 150 along a different branch of the duct and the method returns to Step 660. Steps 660 through 663 are repeated until all branches have been cleaned. If the answer is YES, then the method proceeds to Step 670 and the brush 150 is retrieved to the vicinity of the access hole.

At Step 671, the drive motor 213 is stopped. At Step 672, the operator removes the flexible vacuum hose 140 and rotatable brush 150 from the plenum. At Step 675, both vacuum motors 215*a*, 215*b* are stopped. At Step 680, the service opening is covered with a removable panel. At Step 685, the man-portable pod is returned and coupled to the cart. At Step 690, the air duct cleaner is removed from the premises. At Step 695, the method ends. One who is of skill in the art will recognize that variations to the order in which various of the above steps occur are within the broad scope of the present invention.

Thus, a duct cleaning apparatus and method of cleaning a duct has been described. The duct cleaning apparatus comprises a man-portable pod that is removable from a cart designed to provide rollable transport for the man-portable pod and storage for the accompanying vacuum hose.

Although the present invention has been described in detail, those skilled in the art should understand that they can make various changes, substitutions and alterations herein without departing from the spirit and scope of the invention in its broadest form.

What is claimed is:

1. An apparatus for cleaning ducts of a heating/ventilation/air conditioning (HVAC) system, comprising:

a pod having a vacuum chamber therein;

a flexible vacuum hose having a brush drive shaft contained therein, an end of said brush drive shaft extending from an interior of said flexible vacuum hose;

a brush drive motor located within said pod and configured to receive said end therein; and a conduit member located within said pod adjacent said brush drive motor, said conduit member having a vacuum inlet opening proximate an exterior wall of said pod and a drive shaft exit opening formed in said conduit member through which said end can extend, said conduit member further including a curve along an air path center line of said conduit member, said curve having an obtuse angle taken from a center line normal to said vacuum inlet opening.

2. The apparatus as recited in claim 1 wherein said vacuum inlet opening has an ovoid cross section.

3. The apparatus as recited in claim 1 wherein said curve is a compound curve.

4. The apparatus as recited in claim 1 wherein said obtuse angle is about 139°.

5. The apparatus as recited in claim 1 wherein said conduit member has a vacuum chamber end and a vacuum hose end and an air path therebetween, said vacuum chamber end in fluid communication with said vacuum chamber and said vacuum hose end coupleable to said flexible vacuum hose.

6. The apparatus as recited in claim 5 further comprising a hose attachment having a conduit member end and a hose end wherein a cross sectional area of said conduit member end is substantially greater than a cross sectional area of said hose end wherein said hose attachment is coupleable to said conduit member at said conduit member end, and wherein said hose end is coupleable to said flexible vacuum hose.

7. The apparatus as recited in claim 6 wherein said cross sectional area of said conduit member end is about two times said cross sectional area of said hose end.

8. The apparatus as recited in claim 1 wherein said brush drive motor is bidirectional.

9. The apparatus as recited in claim 1 further comprising a vacuum motor coupled to said vacuum chamber and configured to create a vacuum within said vacuum chamber.

10. The apparatus as recited in claim 9 further comprising a filter located within said vacuum chamber and coupleable to said vacuum motor.

11. The apparatus as recited in claim 10 further comprising a filter catch coupled to said pod proximate said filter and configured to retain said filter coupled to said vacuum motor.

12. The apparatus as recited in claim 9 further comprising an electronic board coupled to said pod proximate said brush drive motor and positioned with respect to said vacuum motor to receive cooling air therefrom.

13. The apparatus as recited in claim 12 wherein said electronic board is electrically coupled to said vacuum motor and said brush drive motor and wherein said electronic board is configured to regulate an operation of said vacuum motor or said brush drive motor.

14. The apparatus as recited in claim 13 further comprising a second vacuum motor and wherein said operation includes a test kill function of a selected one of said vacuum motors.

15. The apparatus as recited in claim 14 wherein said operation includes starting only one of said vacuum motors or said brush drive motor at a time.

16. The apparatus as recited in claim 13 further comprising a remote control coupleable to said electronic board and configured to cause said electronic board to effect said operation.

17. The apparatus as recited in claim 16 wherein said remote control has a start switch and said electronic board is configured to start first one of said vacuum motors and then to start said second vacuum motor in succession upon activation of said start switch.

18. The apparatus as recited in claim 16 wherein said remote control uses low voltage AC electrical power.

19. The apparatus as recited in claim 1 further comprising a cart removably coupleable to said pod and configured to provide rollable conveyance for said pod.

20. The apparatus as recited in claim 19 further comprising a cleat coupled to a front of said pod and configured to mate with a slot in a forward portion of said cart.

21. An apparatus for cleaning ducts of a heating/ventilation/air conditioning (HVAC) system, comprising:

a man-portable pod having a vacuum chamber and a brush drive motor therein;

a flexible vacuum hose having a brush drive shaft contained therein, an end of said brush drive shaft extending from an interior of said flexible vacuum hose and removeably coupleable to said brush drive motor;

a conduit member located within said man-portable pod and having a vacuum chamber end and a vacuum hose end and an air path therebetween, said vacuum chamber end in fluid communication with said vacuum chamber and said vacuum hose end coupleable to an end of said flexible vacuum hose; and a cart removably-coupleable to said man-portable pod and configured to provide rollable conveyance for said man-portable pod.

22. The apparatus as recited in claim 21 further comprising a hose attachment having a conduit member end and a hose end wherein a cross sectional area of said conduit member end is substantially greater than a cross sectional area of said hose end wherein said hose attachment is coupleable to said conduit member at said conduit member end, and wherein said hose end is coupleable to said flexible vacuum hose.

23. The apparatus as recited in claim 21 wherein said brush drive motor is bidirectional.

24. The apparatus as recited in claim 21 further comprising a vacuum motor coupled to said vacuum chamber and configured to create a vacuum within said vacuum chamber.

25. The apparatus as recited in claim 24 further comprising a filter located within said vacuum chamber and coupleable to said vacuum motor.

26. The apparatus as recited in claim 25 further comprising a filter catch coupled to said pod proximate said filter and configured to retain said filter coupled to said vacuum motor.

27. The apparatus as recited in claim 24 further comprising an electronic board coupled to said pod proximate said brush drive motor and positioned with respect to said vacuum motor to receive cooling air therefrom.

28. The apparatus as recited in claim 27 wherein said electronic board is electrically coupled to said brush drive motor and said vacuum motor and wherein said electronic board is configured to regulate an operation of said brush drive motor or said vacuum motor.

29. The apparatus as recited in claim 28 wherein said operation includes reversing a direction of rotation of said brush drive motor.

30. The apparatus as recited in claim 27 further comprising a remote control coupleable to said electronic board and configured to direct said electronic board to effect said operation.

31. The apparatus as recited in claim 30 wherein said remote control uses low voltage AC electrical power.

32. The apparatus as recited in claim 21 wherein said man-portable pod and said cart comprise a molded plastic.

33. The apparatus as recited in claim 21 wherein said man-portable pod further comprises a cleat coupled to a front of said man-portable pod and wherein said cart further comprises a slot in a forward inner portion of said cart and said cleat is configured to be received in said slot.

34. The apparatus as recited in claim 21 wherein said man-portable pod further comprises a carrying handle coupled to an upper surface of said man-portable pod and configured to enable said pod to be carried.

35. The apparatus as recited in claim 21 wherein said man-portable pod further comprises a rear shelf on an upper surface thereof configured to support at least a portion of said flexible vacuum hose for coiled storage.

36. The apparatus as recited in claim 21 wherein said cart comprises a rear fender having a groove therein configured to receive at least a portion of said flexible vacuum hose for coiled storage.

37. The apparatus as recited in claim 21 wherein said cart comprises a left rear fender and a declivity from said left rear fender toward a left front corner of said cart and wherein said declivity is configured to receive at least a portion of said flexible vacuum hose for coiled storage.

38. The apparatus as recited in claim 21 wherein said cart comprises a front post configured to guide at least a portion of said flexible vacuum hose between said man-portable pod and said front post for coiled storage.

39. The apparatus as recited in claim 21 wherein said cart comprises a first portion of a latch and said man-portable pod comprises a second portion of said latch, said first and second portions of said latch configured to cooperate to removably couple said man-portable pod to said cart.

40. A method of manufacturing an apparatus for removing debris from a duct of a heating/ventilation/air conditioning (HVAC) system, comprising:

forming a pod having a vacuum chamber therein;

locating a brush drive motor within said pod, said brush drive motor configured to receive an end of a removable brush drive shaft therein;

locating a conduit member having a vacuum chamber end and a vacuum hose end and an air path therebetween within said pod adjacent said brush drive motor, said conduit member having a vacuum inlet opening at an exterior wall of said pod and a brush drive shaft exit opening formed in said conduit member through which said removable brush drive shaft can extend, said conduit member further including a curve along an air path center line of said conduit member, said curve having an obtuse angle taken from a center line of said vacuum inlet opening; and wherein said vacuum chamber end is in fluid communication with said vacuum chamber and said vacuum hose end is coupleable to a hose attachment; and coupling a hose attachment having a conduit member end to said conduit member, said hose attachment further having a hose end wherein a cross sectional area of said conduit member end is substantially greater than a cross sectional area of said hose end, and wherein said hose end is coupleable to a flexible vacuum hose.

41. The method as recited in claim 40 wherein coupling a hose attachment includes coupling a hose attachment wherein said cross sectional area of said conduit member end is about two times said cross sectional area of said hose end.

42. A method of manufacturing an apparatus for removing debris from a duct of a heating/ventilation/air conditioning (HVAC) system, comprising:

forming a pod having a vacuum chamber therein;

locating a brush drive motor within said pod, said brush drive motor configured to receive an end of a removable brush drive shaft therein; and locating a conduit member within said pod adjacent said brush drive motor, said conduit member having a vacuum inlet opening at an exterior wall of said pod and a brush drive shaft exit opening formed in said conduit member through which said removable brush drive shaft can extend, said conduit member further including a curve along an air path center line of said conduit member, said curve having an obtuse angle taken from a center line of said vacuum inlet opening; and coupling a vacuum motor to said vacuum chamber and configuring said vacuum motor to create a vacuum within said vacuum chamber.

43. The method as recited in claim 42 further comprising locating a filter within said vacuum chamber and coupling said filter to said vacuum motor.

44. The method as recited in claim 43 further comprising coupling a filter catch to said pod proximate said filter and configuring said filter catch to retain said filter coupled to said vacuum motor.

45. The method as recited in claim 42 further comprising coupling an electronic board to said pod proximate said brush drive motor and positioning said electronic board with respect to said vacuum motor to receive cooling air therefrom.

46. The method as recited in claim 45 wherein coupling said electronic board includes electrically coupling said electronic board to said brush drive motor and said vacuum motor and configuring said electronic board to regulate an operation of said brush drive motor or said vacuum motor.

47. The method as recited in claim 46 further comprising providing a remote control coupleable to said electronic board and configuring said remote control to direct said electronic board to effect said operation.

48. The method as recited in claim 47 wherein providing a remote control includes providing said remote control using low voltage AC electrical power.

49. A method of manufacturing an apparatus for removing debris from a duct of a heating/ventilation/air conditioning (HVAC) system, comprising:

forming a pod having a vacuum chamber therein;

locating a brush drive motor within said pod, said brush drive motor configured to receive an end of a removable brush drive shaft therein; and locating a conduit member within said pod adjacent said brush drive motor, said conduit member having a vacuum inlet opening at an exterior wall of said pod and a brush drive shaft exit opening formed in said conduit member through which said removable brush drive shaft can extend, said conduit member further including a curve along an air path center line of said conduit member, said curve having an obtuse angle taken from a center line of said vacuum inlet opening;

providing a cart removably coupleable to said pod and configuring said cart to provide rollable conveyance for said pod; and coupling a cleat to a front of said pod and configuring said cleat to mate with a slot in a forward portion of said cart.

* * * * *

UNITED STATES PATENT AND TRADEMARK OFFICE

CERTIFICATE OF CORRECTION

PATENT NO. : 7,426,768 B2
APPLICATION NO. : 10/860469
DATED : September 23, 2008
INVENTOR(S) : Peterson et al.

It is certified that error appears in the above-identified patent and that said Letters Patent is hereby corrected as shown below:

The title page, showing an illustrative figure, should be deleted and substitute therefor the attached title page.

Delete Drawing Sheets 1-13 and substitute therefor the Drawing Sheets, consisting of Figs 1-6 as shown on the attached pages.

Signed and Sealed this

Fifteenth Day of September, 2009

David J. Kappos

David J. Kappos
*Director of the United States Patent and Trademark Office*

(12) United States Patent
Peterson et al.

(10) Patent No.: US 7,426,768 B2
(45) Date of Patent: Sep. 23, 2008

(54) AIR DUCT CLEANING APPARATUS

(75) Inventors: Scott A. Peterson, Fort Worth, TX (US); Tandy P. Watson, Denton, TX (US); Fred M. Gore, Carrollton, TX (US)

(73) Assignee: Rotobrush International LLC, Grapevine, TX (US)

( * ) Notice: Subject to any disclaimer, the term of this patent is extended or adjusted under 35 U.S.C. 154(b) by 748 days.

(21) Appl. No.: 10/860,469

(22) Filed: Jun. 2, 2004

(65) Prior Publication Data

US 2006/0242783 A1 Nov. 2, 2006

(51) Int. Cl.
*A47L 5/38* (2006.01)
*B08B 9/045* (2006.01)

(52) U.S. Cl. ..... 15/304; 15/329; 15/383; 15/314

(58) Field of Classification Search ..... 15/314, 15/327.1, 327.2, 304, 328, 329, 312.1, 312.2, 15/383

See application file for complete search history.

(56) References Cited

U.S. PATENT DOCUMENTS 2,222,513 A * 11/1940 Mulvaney ..... 15/383
2,521,465 A * 9/1950 Leon ..... 15/327.1
3,063,082 A * 11/1962 Rosenberg ..... 15/327.2
3,180,071 A * 4/1965 Nolte ..... 15/328
3,308,609 A * 3/1967 McCulloch et al. ..... 15/327.1
3,837,539 A * 9/1974 Schiegel ..... 15/327.1
4,792,363 A 12/1988 Franklin et al.
5,309,600 A * 5/1994 Weaver et al. ..... 15/328
5,813,089 A * 9/1998 Nolan et al. ..... 15/383
6,014,790 A 1/2000 Smith et al.
6,032,325 A 3/2000 Smith
6,279,197 B1 8/2001 Crutcher et al.

* cited by examiner

*Primary Examiner*—Laura C Guidotti

(57) ABSTRACT

An apparatus for cleaning ducts of a heating/ventilation/air conditioning (HVAC) system is provided. In one embodiment, a pod has a vacuum chamber therein, a drive motor located within the pod and configured to receive a removable drive shaft therein, and a conduit member located within the pod adjacent the drive motor. The conduit member has a vacuum inlet opening at an exterior wall of the pod and a drive shaft exit opening formed in the conduit member through which the removable drive shaft can extend. In one embodiment, the invention comprises a man-portable pod and a cart removably-coupleable to the man-portable pod. A method of manufacturing the apparatus and a method of cleaning an HVAC duct is also provided.

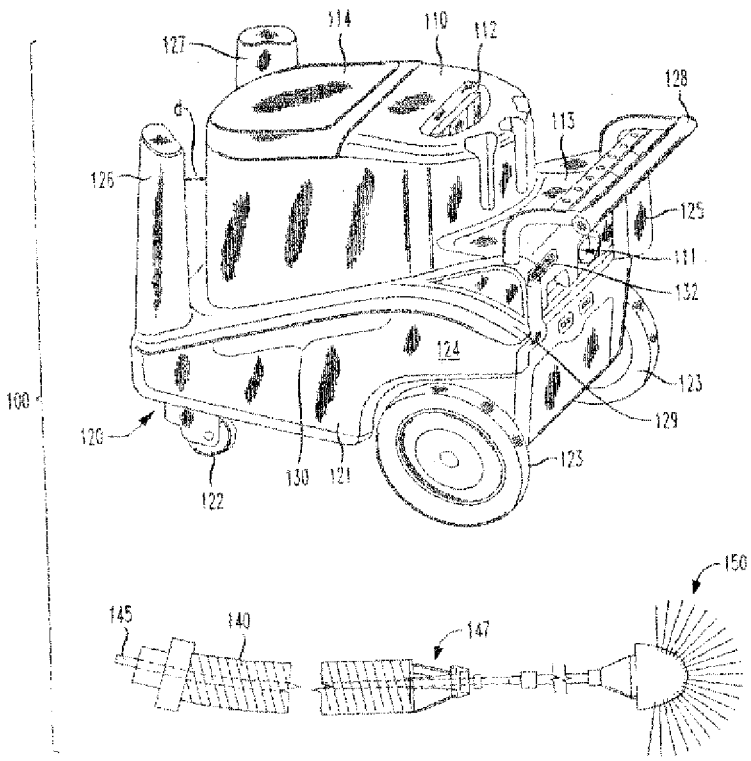

49 Claims, 13 Drawing Sheets